US011998055B2

(12) United States Patent
Rogan et al.

(10) Patent No.: US 11,998,055 B2
(45) Date of Patent: Jun. 4, 2024

(54) ATOMIZER EJECTION MECHANISM FOR AEROSOL INHALER

(71) Applicant: JT International S.A., Geneva (CH)

(72) Inventors: Andrew Robert John Rogan, Forres (GB); Robin Jergen, Zürich (CH); Damir Luso, Schlieren (CH)

(73) Assignee: JT International S.A. (CH)

( * ) Notice: Subject to any disclaimer, the term of this patent is extended or adjusted under 35 U.S.C. 154(b) by 352 days.

(21) Appl. No.: 17/291,751

(22) PCT Filed: Dec. 4, 2019

(86) PCT No.: PCT/EP2019/083749
§ 371 (c)(1),
(2) Date: May 6, 2021

(87) PCT Pub. No.: WO2020/115173
PCT Pub. Date: Jun. 11, 2020

(65) Prior Publication Data

US 2022/0022552 A1 Jan. 27, 2022

(30) Foreign Application Priority Data

Dec. 5, 2018 (EP) ..... 18210528
Dec. 5, 2018 (EP) ..... 18210529
(Continued)

(51) Int. Cl.
*A24F 40/85* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/60* (2020.01); *A24F 40/85* (2020.01)

(58) Field of Classification Search
CPC ..... A24F 40/485; A24F 40/10; A24F 40/42; A24F 40/60; A24F 40/85; A24F 7/00
See application file for complete search history.

(56) References Cited

U.S. PATENT DOCUMENTS 9,693,584 B2 7/2017 Hearn et al.
10,021,911 B2 7/2018 Xu
(Continued)

FOREIGN PATENT DOCUMENTS

CN 206119181 U 4/2017
CN 107072303 A 8/2017
(Continued)

OTHER PUBLICATIONS

International Search Report for PCT/EP2019/083749 dated Feb. 28, 2020; 3 pages.
(Continued)

*Primary Examiner* — Truc T Nguyen
(74) *Attorney, Agent, or Firm* — Lerner David LLP

(57) ABSTRACT

An electronic cigarette has a mouthpiece portion and a power supply portion. The mouthpiece portion has an atomizer seating to receive an atomizer. An atomizer lock is located in the atomizer seating and is moveable between an open position and a locked position. An ejection mechanism with a biased ejection surface is moveable within the atomizer seating and is biased toward an extended position. The ejection mechanism is moved to a retracted position when an atomizer is introduced to the atomizer seating; the atomizer lock grips the atomizer to hold it in a fixed position. The atomizer is ejected from the atomizer seat when the atomizer lock is opened.

10 Claims, 16 Drawing Sheets

(30) Foreign Application Priority Data

Dec. 5, 2018 (EP) ..... 18210530
Dec. 5, 2018 (EP) ..... 18210531

(51) Int. Cl.
*A24F 40/42* (2020.01)
*A24F 40/485* (2020.01)
*A24F 40/60* (2020.01)

(56) References Cited

U.S. PATENT DOCUMENTS 11,524,823 B2 12/2022 McKeon et al.
2008/0140207 A1 6/2008 Olmos et al.
2011/0005535 A1 1/2011 Xiu
2011/0011396 A1 1/2011 Fang
2011/0315152 A1 12/2011 Hearn et al.
2013/0333711 A1* 12/2013 Liu ..... A24F 40/60 131/329
2013/0340779 A1* 12/2013 Liu ..... A24F 40/44 131/329
2014/0069424 A1 3/2014 Poston et al.
2014/0150784 A1* 6/2014 Liu ..... A24F 40/42 128/202.21
2014/0332019 A1 11/2014 Liu
2014/0360514 A1 12/2014 Zhu
2015/0173421 A1* 6/2015 Hsieh ..... A24F 40/50 200/43.01
2015/0245654 A1 9/2015 Memari et al.
2015/0245668 A1 9/2015 Memari et al.
2015/0282530 A1 10/2015 Johnson et al.
2015/0366267 A1* 12/2015 Liu ..... A24F 40/44 131/329
2016/0015081 A1* 1/2016 Liu ..... H05B 3/16 131/329
2016/0044964 A1 2/2016 Liu
2016/0150828 A1 6/2016 Goldstein et al.
2016/0176564 A1 6/2016 Garthaffner
2016/0183597 A1 6/2016 Li et al.
2016/0242468 A1 8/2016 Liu
2016/0366945 A1 12/2016 Rado
2017/0006915 A1 1/2017 Li et al.
2017/0013882 A1 1/2017 Liu
2017/0119060 A1 5/2017 Li et al.
2017/0196264 A1 7/2017 Liu
2017/0215476 A1 8/2017 Dickens et al.
2017/0231274 A1 8/2017 Davis et al.
2017/0265526 A1 9/2017 Li et al.
2017/0273359 A1 9/2017 Liu
2018/0000156 A1 1/2018 Qiu
2018/0027880 A1 2/2018 Dong et al.
2018/0077968 A1* 3/2018 Qiu ..... A24F 40/46
2018/0084830 A1 3/2018 Xu
2018/0103684 A1 4/2018 Liu
2018/0116284 A1 5/2018 Biel et al.
2018/0116287 A1 5/2018 Dai et al.
2018/0132533 A1* 5/2018 Chen ..... A24F 40/485
2018/0184711 A1 7/2018 Dickens et al.
2018/0255836 A1 9/2018 Qiu
2018/0263287 A1 9/2018 Jiang et al.
2018/0271174 A1 9/2018 Qiu
2018/0310614 A1 11/2018 Xu
2018/0317551 A1 11/2018 Daryani et al.
2018/0325178 A1 11/2018 Zhao et al.
2018/0343924 A1 12/2018 Lin et al.
2019/0014822 A1* 1/2019 Bless ..... H05B 1/0244
2019/0031407 A1 1/2019 Biel et al.
2019/0053544 A1 2/2019 Yamada et al.
2019/0223499 A1* 7/2019 Ouyang ..... H01M 50/107
2019/0297953 A1* 10/2019 Qiu ..... A61M 11/042
2019/0328044 A1* 10/2019 Qiu ..... A24F 40/42
2019/0350263 A1* 11/2019 Qiu ..... A24F 40/485
2020/0146351 A1 5/2020 Rogan
2022/0000176 A1 1/2022 Rogan et al.
2022/0000180 A1 1/2022 Rogan et al.
2022/0007730 A1 1/2022 Rogan et al.
2022/0022552 A1 1/2022 Rogan et al.
2023/0329347 A1* 10/2023 Li ..... A24F 40/10

FOREIGN PATENT DOCUMENTS

CN 206565292 U 10/2017
CN 107809918 A 3/2018
CN 107865461 A 4/2018
CN 207653565 U 7/2018
CN 113163864 A 7/2021
CN 113163868 A 7/2021
CN 113164695 A 7/2021
EP 3020290 A1 5/2016
EP 3025602 A2 6/2016
EP 3095338 A1 11/2016
EP 3205597 A1 8/2017
EP 3298914 A1 3/2018
WO 2010073018 A1 7/2010
WO 2015128665 A1 9/2015
WO 2017093452 A1 6/2017
WO 2017187545 A1 11/2017
WO 2017203407 A1 11/2017

OTHER PUBLICATIONS

International Search Report for PCT/EP2019/083748 dated Feb. 25, 2020; 6 pages.
International Search Report for PCT/EP2019/083750 dated Feb. 19, 2020; 3 pages.
International Search Report for PCT/EP2019/083751 dated Feb. 19, 2020; 3 pages.
Farsalinos, K. E. et al., "Protocol proposal for, and evaluation of, consistency in nicotine delivery from the liquid to the aerosol of electronic cigarettes atomizers: regulatory implications" Addiction Research Report, SSA Society for the Study of Addiction, Jan. 2016, pp. 1-8, vol. 111, Issue 6.
Xiaoxu, Z. et al., "Research on chemical composition and atomization behavior of E-cigs liquid by electrical heating atomizing electronic cigarettes" OOD & MACHINERY, Nov. 2017, pp. 1-6, vol. 33, No. 11. English Translation of Abstract only.

* cited by examiner

ATOMIZER EJECTION MECHANISM FOR AEROSOL INHALER

CROSS-REFERENCE TO RELATED APPLICATIONS

The present application is a national phase entry under 35 U.S.C. § 371 of International Application No. PCT/EP2019/083749, filed Dec. 4, 2019, published in English, which claims priority to European Application No. 18210528.8 filed Dec. 5, 2018, European Application No. 18210529.6 filed Dec. 5, 2018, European Application No. 18210530.4 filed Dec. 5, 2018, and European Application No. 18210531.2 filed Dec. 5, 2018, the disclosures of which are incorporated herein by reference.

FIELD OF THE INVENTION

The present invention relates to an assembly for ejecting an atomizer in an aerosol inhaler.

BACKGROUND

Electronic cigarettes and other aerosol inhalers are becoming increasingly popular consumer products. In these products, an aerosol-forming substance is stored in a tank in liquid form. The tank typically has an outlet connected to a wicking or fluid transfer element which supplies the aerosol forming substance to an atomiser. In addition to the fluid transfer element, the atomiser also includes a heating arrangement that vaporises the liquid aerosol forming substance. A battery is connected to the atomiser, which is typically activated to produce vapour by a button or an air pressure sensor. Air inlets and airflow channels are provided so that the user can draw air into the device through or past the atomiser.

These types of electronic cigarettes may have a separate and removable atomiser. The atomiser needs to be replaced at regular intervals. When replacing the atomizer, the user typically disassembles a mouthpiece portion from a power supply portion of the electronic cigarette in order to manually grasp and remove the atomizer. There can be liquid remaining in the atomiser which the user may accidentally get into contact with.

SUMMARY

An object of the present invention is to overcome and mitigate some of the above-mentioned problems.

According to an aspect, the present invention provides a mouthpiece portion of an electronic cigarette, the mouthpiece portion comprising a mouthpiece having a liquid store, an atomizer-receiving portion, a vapour outlet, and a vapour flow tube, the vapour flow tube having an axial extension between the atomizer-receiving portion and the vapour outlet, wherein the liquid store has a liquid opening in a bottom portion thereof, and wherein the mouthpiece portion further comprises an axially moveable closing member which is movable between an open position and a closed position, wherein the axially moveable closing member is biased towards the closed position to seal the liquid opening, and wherein the axially moveable closing member is urged towards the open position when an atomizer is present in the atomizer-receiving portion. In this way the liquid opening of the liquid store can be automatically opened by the presence of an atomizer and atomically closed by the biased axially moveable closing member when an atomizer is not present.

This obviates the need for a user to manually open and close the liquid opening and reduces the likelihood of spillage of liquid from the liquid store. Preferably the axially moveable closing member is biased by a spring.

Preferably the axially moveable closing member is guided by the vapour flow tube, or the axially moveable closing member is guided by an internal side of the liquid store. In this way the closing member is guided to the liquid opening thereby ensuring that a complete closing of the opening is achieved.

Preferably the closing member is a tubular sleeve. In this way the tubular sleeve shape allows for interaction with the vapour flow tube to enhance the guiding interaction as well as a closing of the liquid opening.

Preferably the tubular sleeve is located around the vapour tube. In this way the guiding interaction between the vapour flow tube and the axially moveable closing member is enhanced.

Preferably the closing member has a sealing end provided with a horizontal flange, and wherein the flange is configured to seal against a bottom surface of the liquid store comprising the liquid opening. In this way the horizontal flange ensures a complete coverage of the liquid opening whist minimising the total volume inside the liquid store that is dedicated to the axially moveable closing member. Preferably the horizontal flange extends radially from the closing member Preferably the sealing end further comprises a resilient seal connected to the horizontal flange and configured to seal against the bottom surface of the liquid store comprising the liquid opening and close the liquid opening. In this way the resilient seal is compressible against the bottom surface of the liquid store enhancing the prevention of liquid leakage.

Preferably the axially moveable closing member is moveable in the axial direction when a liquid refill arrangement is present in the atomizer-receiving portion. In this way the axially moveable closing member and liquid opening provide a closeable opening which is also opened by the presence of a liquid refill arrangement such that the opening is opened in the presence of the liquid refill arrangement and automatically closes upon the removal of the liquid refill arrangement. This reduces the likelihood of liquid spillage when refilling the liquid store.

According to another aspect, the present invention provides an electronic cigarette comprising a mouthpiece portion provided with a mouthpiece, a power supply portion and an atomizer, wherein the mouthpiece portion comprises an atomizer-receiving portion configured to receive an upper portion of the atomizer, and wherein the power supply portion comprises an atomizer seating configured to receive a lower portion of the atomizer, wherein the mouthpiece portion comprises a liquid store having a liquid opening in a bottom portion thereof and a vapour flow tube extending from the receiving cavity to the mouthpiece, and wherein the mouthpiece portion further comprises an axially moveable closing member which is movable between an open position and a closed position, wherein the closing member is biased towards the closed position to seal the liquid opening, and wherein the closing member is urged towards the open position when the atomizer is received in the atomizer-receiving portion. In this way the liquid opening of the liquid store is automatically opened and closed based upon the presence of the atomizer or lack thereof. This obviates the need for a user to manually open and close the liquid opening and reduces the likelihood of spillage of liquid from the liquid store. Preferably the axially moveable closing member is biased by a spring.

Preferably the axially moveable closing member is guided by the vapour flow tube, or the axially moveable closing member is guided by an internal side of the liquid store. In this way the closing member is guided to the liquid opening thereby ensuring that a complete closing of the opening is achieved.

Preferably the atomizer comprises at least one liquid inlet, a fluid transfer element and a heating element, and wherein the atomizer liquid inlet is configured to extend into the atomizer-receiving portion of the mouthpiece portion such that the atomizer abuts the axially moveable closing member and the axially moveable closing member is released from a surface of the liquid store comprising the liquid opening such that a fluidic connection between the liquid store and the fluid transfer element is established through the liquid inlet when the mouthpiece portion is connected to the power supply portion and the atomizer is present in the atomizer seating. In this way liquid from the liquid store can automatically enter the atomizer when the mouthpiece portion is connected to the power supply portion and the atomizer is present in the atomizer seating. Correspondingly, when the atomizer is not present, such as when the power supply portion is not connected to the mouthpiece portion, the liquid opening is automatically closed. This simplifies the operation of the device for the user whilst minimising the risk of leakage from the liquid store.

According to another aspect, the present invention provides a refillable reservoir portion of an electronic cigarette, the refillable reservoir portion comprising a refillable liquid store, an axially moveable valve closing member and a first biasing member, wherein the refillable liquid store is provided with a liquid opening in a bottom portion thereof and the axially moveable valve closing member is moveable between an open position and a closed position, wherein the first biasing member configured to bias the axially moveable closing valve member towards the closed position to seal the liquid opening, and wherein the axially moveable valve closing member is moved into the open position when the refillable reservoir portion and a refilling bottle are engaged with each other. In this way the liquid opening of the refillable liquid store can be automatically closed by the biasing applied to the axially moveable valve closing member by the first biasing member. This obviates the need for a user to manually close the liquid opening and reduces the likelihood of spillage of liquid from the liquid store. Preferably the first biasing member is a spring.

Preferably the axially moveable valve closing member is guided by a vapour flow tube. In this way the closing member is guided to the liquid opening thereby ensuring that a complete closing of the opening is achieved.

Preferably the axially moveable valve closing member is a tubular sleeve which is located around the vapour tube. In this way the tubular sleeve shape allows for interaction with the vapour flow tube to enhance the guiding interaction as well as a closing of the liquid opening.

According to another aspect, the present invention provides a refilling bottle configured to connect with a refillable reservoir portion of an electronic cigarette, the refilling bottle comprising a liquid tank configured to store a liquid, and a liquid transfer arrangement configured to transfer liquid from the liquid tank to a refillable liquid store in an electronic cigarette, the liquid transfer arrangement having a housing, a connection portion attached to the liquid tank and an axially moveable refilling valve located inside the housing and movable between a closed position and an open position, wherein the axially moveable refilling valve is biased towards the closed position by a second biasing member. In this way the tank can be automatically closed by the biasing applied by the second biasing member. This obviates the need for a user to manually close the refilling bottle and reduces the likelihood of spillage of liquid from the liquid tank. Preferably the second biasing member is a spring.

Preferably the axially moveable refilling valve comprises a plunger having a liquid intake portion located within the liquid tank and a liquid delivery portion located outside the liquid tank and configured to be introduced into a refillable reservoir portion of an electronic cigarette, wherein the plunger is urged towards an open position when the liquid delivery portion is moved into a receiving portion of the refillable reservoir portion of an electronic cigarette. In this way the a user does not have to manually open the refilling bottle before bringing it into agreement with a refillable reservoir portion of an electronic cigarette as the plunger is automatically urged to an open position when the refilling bottle is moved into the receiving portion of a refillable reservoir portion of an electronic cigarette. This reduces the likelihood of liquid spillage when using the bottle to refill an electronic cigarette.

Preferably the liquid intake portion comprises at least one liquid inlet and the liquid delivery portion comprises at least one liquid outlet, wherein the at least one liquid inlet and the at least one liquid outlet are in fluid connection, and the at least one liquid inlet and the at least one liquid outlet extend respectively, at least partially, in a transverse direction, relative to the axial direction of the plunger. In this way liquid can flow from the liquid tank to a refillable reservoir portion of an electronic cigarette by way of the plunger.

Preferably the housing further comprises an annular seal and wherein the at least one liquid inlet is separated from the liquid tank by the seal when the plunger is in a closed position. In this way the likelihood of leakage from the bottle is reduced.

Preferably the liquid delivery portion of the plunger further comprises an annular seal which is located below the at least one liquid outlet, wherein the seal is configured to seal against an internal housing of the refillable reservoir portion of an electronic cigarette. In this way the likelihood of leakage from the bottle is reduced.

Preferably when the plunger is biased into a closed position, the liquid intake portion is sealed against an inner surface of the liquid transfer arrangement. In this way liquid in the liquid tank cannot pass into the plunger, and therefore cannot escape the liquid tank, when the plunger is in a closed position.

According to another aspect, the present invention provides a liquid refilling system for an electronic cigarette, the liquid refilling system comprising a refillable reservoir portion of an electronic cigarette and a refilling bottle. The refillable reservoir portion comprises a refillable liquid store, an axially moveable valve closing member and a first biasing member, wherein the refillable liquid store is provided with a liquid opening in a bottom portion thereof and the axially moveable valve closing member is moveable between an open position and a closed position, wherein the first biasing member configured to bias the axially moveable closing valve member towards the closed position to seal the liquid opening, and wherein the axially moveable valve closing member is moved into the open position when the refillable reservoir portion and a refilling bottle are engaged with each other. The refilling bottle is configured to connect with a refillable reservoir portion of an electronic cigarette, the refilling bottle comprising a liquid tank configured to store a liquid, and a liquid transfer arrangement configured to transfer liquid from the liquid tank to a refillable liquid store in an electronic cigarette, the liquid transfer arrangement having a housing, a connection portion attached to the liquid tank and an axially moveable refilling valve located inside the housing and movable between a closed position and an open position, wherein the axially moveable refilling valve is biased towards the closed position by a second biasing member. In this way the liquid opening of the refillable liquid store can be automatically closed by the biasing applied to the axially moveable closing member by the first biasing member. This obviates the need for a user to manually close the liquid opening and reduces the likelihood of spillage of liquid from the liquid store. The tank can be automatically closed by the biasing applied by the second biasing member. This obviates the need for a user to manually close the refilling bottle and reduces the likelihood of spillage of liquid from the liquid tank. In this way an electronic cigarette can be refilled in a controlled manner, negating liquid spillage.

Preferably the axially moveable valve closing member is guided by a vapour flow tube. In this way the closing member is guided to the liquid opening thereby ensuring that a complete closing of the opening is achieved.

Preferably the axially moveable valve closing member is a tubular sleeve which is located around the vapour tube. In this way the tubular sleeve shape allows for interaction with the vapour flow tube to enhance the guiding interaction as well as a closing of the liquid opening.

Preferably the axially moveable refilling valve comprises a plunger having a liquid intake portion located within the liquid tank and a liquid delivery portion located outside the liquid tank and configured to be introduced into a refillable reservoir portion of an electronic cigarette, wherein the plunger is urged towards an open position when the liquid delivery portion is moved into a receiving portion of the refillable reservoir portion of an electronic cigarette. In this way the a user does not have to manually open the refilling bottle before bringing it into agreement with a refillable reservoir portion of an electronic cigarette as the plunger is automatically urged to an open position when the refilling bottle is moved into the receiving portion of a refillable reservoir portion of an electronic cigarette. This reduces the likelihood of liquid spillage when using the bottle to refill an electronic cigarette.

Preferably the liquid intake portion comprises at least one liquid inlet and the liquid delivery portion comprises at least one liquid outlet, wherein the at least one liquid inlet and the at least one liquid outlet are in fluid connection, and the at least one liquid inlet and the at least one liquid outlet extend respectively, at least partially, in a transverse direction, relative to the axial direction of the plunger. In this way liquid can flow from the liquid tank to a refillable reservoir portion of an electronic cigarette by way of the plunger.

Preferably the housing further comprises an annular seal and wherein the at least one liquid inlet is separated from the liquid tank by the seal when the plunger is in a closed position. In this way the likelihood of leakage from the bottle is reduced.

Preferably the liquid delivery portion of the plunger further comprises an annular seal which is located below the at least one liquid outlet, wherein the seal is configured to seal against an internal housing of the refillable reservoir portion of an electronic cigarette. In this way the likelihood of leakage from the bottle is reduced.

Preferably when the plunger is biased into a closed position, the liquid intake portion is sealed against an inner surface of the liquid transfer arrangement. In this way liquid in the liquid tank cannot pass into the plunger, and therefore cannot escape the liquid tank, when the plunger is in a closed position.

Preferably the first biasing member has a first spring coefficient and the second biasing member has a second spring coefficient, wherein the first spring coefficient is smaller than the second spring coefficient such that the axially moveable valve closing member in the refillable liquid store opens before the axially moveable refilling valve in the liquid transfer arrangement of the refill bottle, upon engagement between the refill bottle and the refillable reservoir portion of the electronic cigarette. In this way the refillable liquid store will always be open to receive liquid from the refilling bottle when the refilling valve of the bottle is in an open position thereby preventing liquid from leaving the refilling bottle and not being be able to enter the liquid store of the electronic cigarette thus reducing the risk of spillage.

According to another aspect, the present invention provides an electronic cigarette comprising a mouthpiece portion and a power supply portion, wherein the power supply portion comprises an atomizer seating configured to receive an atomizer, an atomizer lock located in the atomizer seating and movable between an open position and a locked position, wherein the atomizer lock is configured to selectively grip the atomizer when it is received in the atomizer seating and release the atomizer from the atomizer seating, and an ejection mechanism comprising a biased ejection surface movable within the atomizer seating between a retracted position and an extended position, wherein the ejection surface is biased towards the extended position, wherein the ejection mechanism is movable into the retracted position when an atomizer is introduced into the atomizer seating, and the atomizer lock is configured to grip the atomizer and hold it in a fixed position, and wherein the atomizer is ejected from the atomizer seating when the atomizer lock is opened. In this way the atomizer can be easily released from the electronic cigarette.

Preferably the atomizer lock includes an outer sleeve and an inner sleeve, which is movable in relation to the outer sleeve, and an actuator configured to selectively move the inner sleeve relative to the outer sleeve in order to grip or release the atomizer. In this way the user can operate the actuator to lock and unlock the atomizer so that it can be easily released from the electronic cigarette.

Preferably the actuator is configured to rotate the inner sleeve in relation to the outer sleeve, and the atomizer is configured to rotate in unison with the inner sleeve. More preferably the atomizer is gripped or released depending on the rotational position of the inner sleeve in relation to the outer sleeve. More preferably the electronic cigarette further comprises the atomizer which comprises a first engagement element configured to engage with the inner sleeve and a second engagement element configured to engage with the outer sleeve. In this way each of these preferences contributes to providing a user-friendly mechanism that is both quick and simple to operate.

Preferably the second engagement element is an annular flange and the first engagement element is a slot or cut-out in the annular flange that defines an axial keyway through the flange. More preferably the inner sleeve comprises a second protrusion and the outer sleeve comprises a first protrusion, wherein the first and second protrusions extend radially inwards into the atomizer seating, and wherein the first protrusion on the outer sleeve can be aligned with the second protrusion upon rotation of the actuator such that the keyway of the atomizer can pass in the axial direction over the first and the second protrusion and be accommodated in the atomizer seating. In this way the atomizer can be easily received in the atomizer seating when the atomizer lock is in an unlocked position, requiring minimal user effort.

Preferably the first protrusion is axially positioned to be aligned with the annular flange and the second protrusion is axially positioned to be above the first protrusion such that the annular flange can pass below the second protrusion wherein the annular flange of the atomizer is unlocked from the atomizer seating when the first and second protrusions are aligned with each other such that the atomizer is released from the atomizer seating, and the annular flange of the atomizer is locked in the atomizer seating when the first and second protrusions are misaligned from each other such that the second protrusion is positioned above and abutting the annular flange. In this way, the atomizer can be received in and ejected from atomizer seating when the first protrusion and second protrusion are in alignment such that the atomizer lock is in an unlocked arrangement. The atomizer can be locked into the atomizer seating by rotating the inner sleeve such that the annular flange of the atomizer is held in place by the second protrusion when the first and second protrusions are misaligned so that the atomizer lock is in a locked arrangement. The atomizer can therefore be easily received, locked and released from the atomizer seating.

Preferably the inner sleeve comprises one or more resilient tongues and the outer sleeve comprises slots configured to accommodate the resilient tongues. In this way the slots provide defined locked and unlocked positions such that the movement of the tongues between the slots provides the user with a haptic feedback thereby indicating to the user that electronic cigarette has moved between the locked and unlocked positions. Preferably the outer sleeve comprises two sets of slots, one set corresponding to the unlocked position and the other set corresponding to the locked position.

Preferably the resilient tongues comprise free guiding ends to enable the tongues to move in and out of the slots when a torque above a threshold level is applied to the inner sleeve. In this way a smooth movement between the slots is achieved, making it easier for the user to lock and unlock the atomizer. Preferably the free guiding ends have a rounded shape.

Preferably the atomizer is biased in a direction out of the atomizer seating, such that when the atomizer is released from the atomizer lock, the atomizer is ejected. In this way the atomizer is fully ejected from the atomizer seating without requiring physical contact between a user and the atomizer.

Preferably the power supply portion comprises the biased ejection surface and a biasing member and wherein the biasing member is biased against a stationary surface in the power supply portion and provides the biasing for the ejection mechanism. In this way the atomizer ejected outward from the atomizer seating without requiring physical contact between a user and the atomizer. Preferably the biased surface is an electrical terminal. In this way a separate biasing member and electrical terminal are not required, thereby minimising the number of required components and providing a more compact device.

Preferably the actuator is configured to axially move the inner sleeve in relation to the outer sleeve between an extended position and a retracted position such that the atomizer is locked to the inner sleeve as the inner sleeve is retracted into the outer sleeve.

Preferably the inner sleeve is provided with a connector in the form of a clasp configured to engage with a circular groove on the atomizer. Preferably the stationary surface is an abutment formed in the inner sleeve and whereby the axial position of the abutment surface is displaceable in the longitudinal axial direction of the power supply portion.

According to an aspect, the present invention provides an electronic cigarette, comprising a mouthpiece portion connectable to a power supply portion of an electronic cigarette, wherein the mouthpiece portion comprises a refillable liquid store having a sealable opening, a valve closing member and an atomizer receiving section, wherein the valve closing member is configured to seal the opening and control a flow of liquid from the liquid store to the atomizer receiving section by movement between an open position and a closed position, whereby a flow of liquid is enabled from the refillable liquid store to an atomizer in the atomizer receiving section when an atomizer is present in the atomizer-receiving section and when the valve closing is moved towards the open position, the electronic cigarette further comprising an actuator for axially moving the atomizer away from the valve closing member into a portion of the power supply portion such that the valve closing member seals the opening. In this way the electronic cigarette can be disabled to prevent the egress of liquid from the liquid store. This is especially useful when the electronic cigarette is likely to be subject to changes in air pressure which could otherwise force liquid out of the liquid store.

Preferably the electronic cigarette further comprises a power supply portion with an atomizer seating configured to receive a lower portion of an atomizer, whereby the atomizer-receiving section in the mouthpiece portion is configured to receive an upper portion of the atomizer, and wherein the valve closing member can be urged toward an open position by the upper portion of the atomizer in the atomizer seating. In this way the valve closing member can be easily opened and closed by movement of the atomizer.

Preferably the atomizer is connectable to an inner sleeve at the atomizer seating, and the inner sleeve is axially moveable in relation to an outer sleeve. In this way the atomizer can be moved toward and away from the valve thereby providing a mechanism for the user to easily open and close the valve.

Preferably the atomizer is moveable toward the valve closing member by axially moving the inner sleeve in relation to the outer sleeve to urge the valve toward the open position, and the atomizer is moveable away from the valve closing member by axially moving the inner sleeve in a retracting direction in relation to the outer sleeve such that the valve closing member cannot be urged toward the open position. In this way the user can easily close the valve to enable a flight safe mode so that changes in air pressure do not force liquid out of the liquid store.

Preferably a portion of the actuator is comprised in the outer sleeve and the electronic cigarette further comprises a guiding arrangement, configured to provide the axial movement of the inner sleeve. In this way the user can physically control when the valve is opened and closed.

Preferably the guiding arrangement comprises a guiding thread or groove wherein the inner sleeve is coupled to the guide through a follower pin, whereby the inner sleeve is movable in the axial direction when the portion of the actuator comprised in the outer sleeve is actuated. In this way the user can move the atomizer toward and away from the valve by twisting the actuator, thereby providing a simple to operate mechanism for the user to open and close the valve.

Preferably the inner sleeve is connected to the portion of the actuator comprised in the outer sleeve, wherein the portion of the actuator is an axially moveable actuator, such as a sliding actuator for direct axial movement of the inner sleeve in relation to the outer sleeve. In this way the user can move the atomizer toward and away from the valve by sliding the actuator, thereby providing a simple to operate mechanism for the user to open and close the valve.

Preferably the inner sleeve comprises resilient clasps and the outer sleeve comprises slots defined by bulges extending radially inwards, wherein the atomizer comprises a first engagement element in the form of an annular groove, and wherein the clasps are configured to connect to the annular groove and move within the slots to axially displace the atomizer. In this way the atomizer can be gripped by the inner sleeve and guided inward and outward of the outer sleeve.

Preferably the atomizer further comprises a first angled surface defining a lower ledge of the annular groove configured to enable the clasps to move into the annular groove, over the first angled surface, when the atomizer is pressed against the inner sleeve. In this way a secure grip is provided between the inner sleeve and the actuator. Furthermore a haptic feedback is provided to the user as the clasps snap over the first angled surface as they move into the annular groove during engagement of the atomizer. This haptic feedback can indicate that the atomizer is securely arranged in the electronic cigarette. Likewise a haptic feedback is provided to the user when the clasps snap back over the first angled surface during disengagement of the atomizer so that the user is aware that the atomizer is disengaged.

Preferably the atomizer further comprises a second angled surface defining an upper ledge of the annular groove configured to abut the bulges when the inner sleeve is retracted in relation to the outer sleeve thereby releasing the atomizer from the clasps of the inner sleeve. In this way the second angled surface of the atomizer interacts with the bulges to apply a resistance to the atomizer opposing the inwardly directed movement of the atomizer with respect to the outer sleeve. As the atomizer is retracted into the outer sleeve the atomizers path is blocked by the bulges. This allows for the atomizer to move away from the valve to close the liquid store but without then being retractable all the way into the outer sleeve. Advantageously, because the atomizer is prevented from retracting further whilst the inner sleeve continues to retract, the atomizer becomes disengaged from the inner sleeve. If the mouthpiece portion is removed, the disengagement of the atomizer from the inner sleeve, due to the interaction with the bulges, allows for the user to easily remove the atomizer without physically contacting it. Another advantage is that, if the atomizer is electrically connected to the electronic cigarette by the inner sleeve, for example through a biased abutment surface which retracts with the inner sleeve, it allows for a simple electrical disconnection of the atomizer when the inner sleeve retracts and the atomizer is prevented from retracting further.

Any combination of the preceding preferable features can be included in any of the preceding aspects where appropriate.

BRIEF DESCRIPTION OF THE DRAWINGS

Embodiments of the invention are now described, by way of example, with reference to the drawings, in which.

DETAILED DESCRIPTION

Figure 1A:
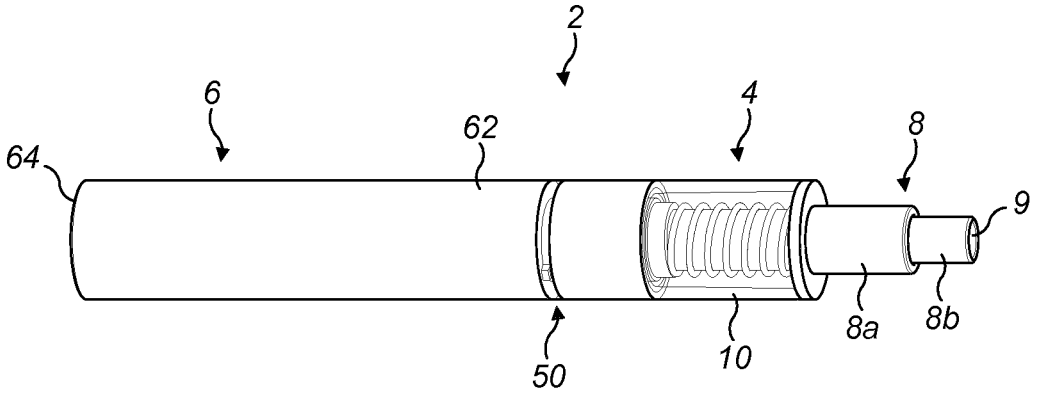
FIGS. 1*a* and 1*b* show electronic cigarettes according to embodiments of the present invention.
Figure 1B:
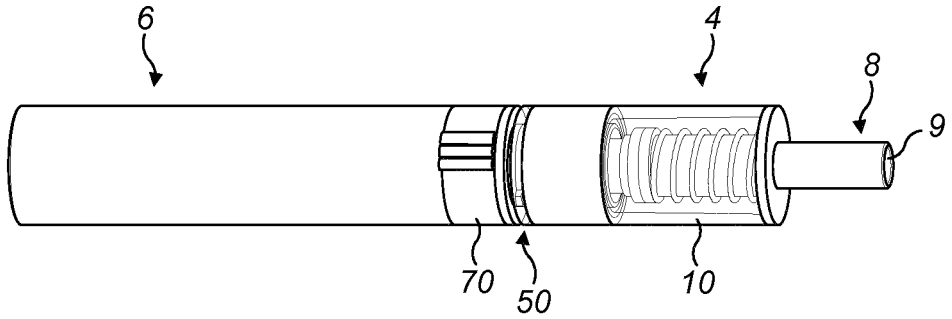
Figure 1C:
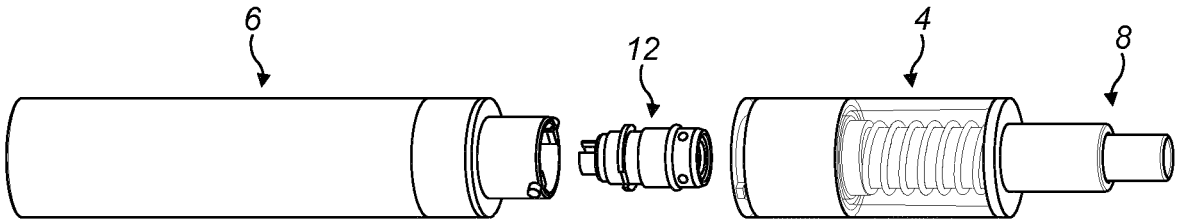
FIG. 1*c* shows an exploded view of an electronic cigarette according to embodiments of the invention.

Referring to FIGS. 1*a* to 1*c*, an electronic cigarette 2 according to embodiments of the present invention is illustrated. The electronic cigarette 2 comprises mouthpiece portion 4, a power supply portion 6 and an atomizer 12 which are releasably connected to each other.

Figure 5B:
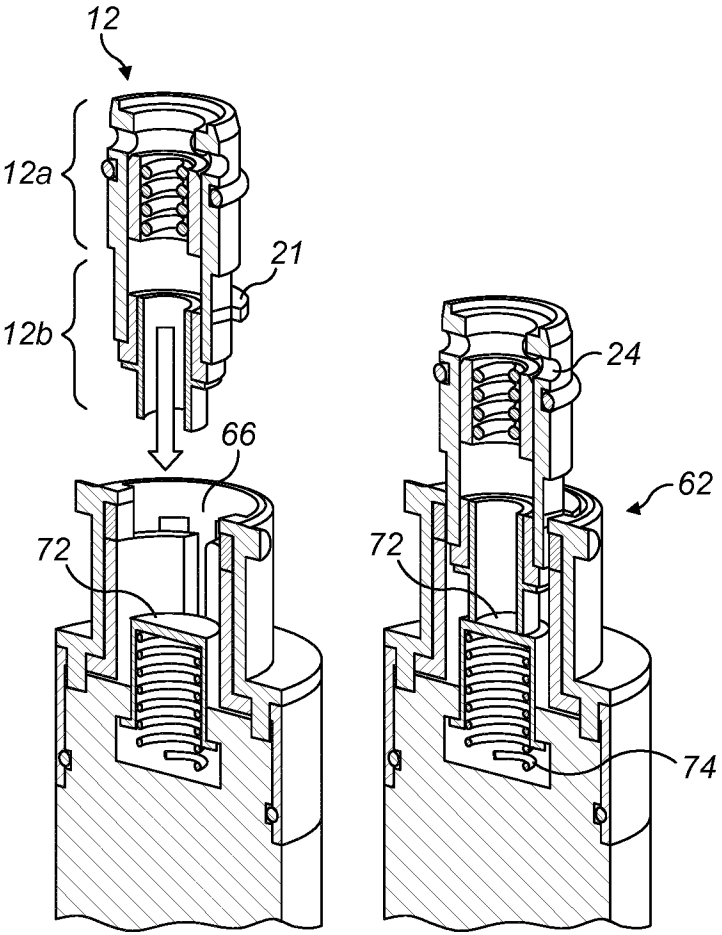
FIG. 5*b* shows cross-sectional diagrams of an atomizer being received in a power supply portion of an electronic cigarette according to an embodiment of the present invention.
Figure 5A:
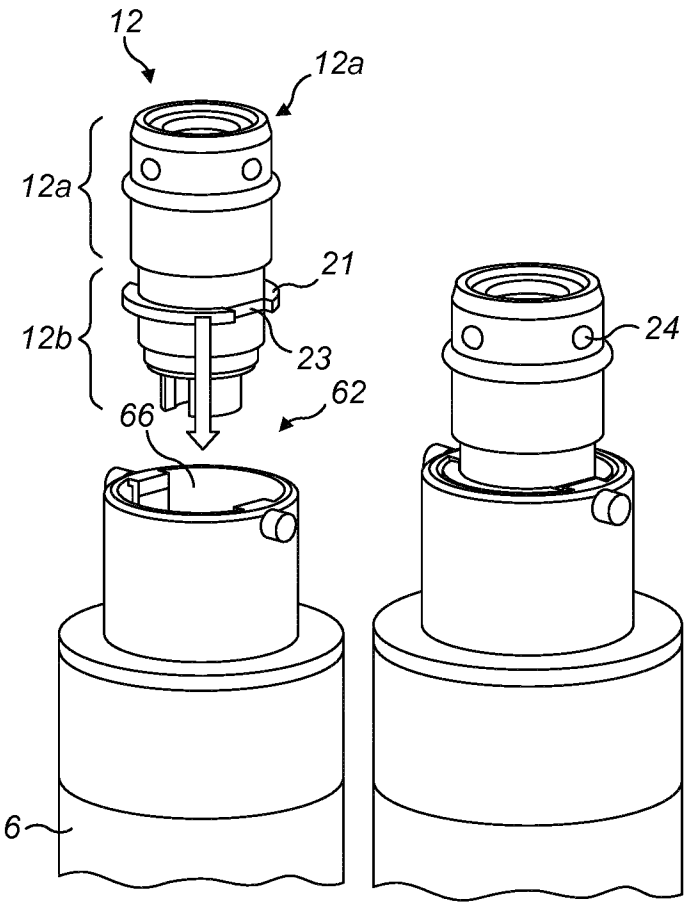
FIG. 5*a* shows diagrams of an atomizer being received in a power supply portion of an electronic cigarette according to an embodiment of the present invention.

The power supply portion 6 is provided as an elongate body having a proximal end 62 connectable to the mouthpiece portion 4 and an opposite distal end 64, a power supply unit or battery and an electrical circuitry (not shown). The distal end 64 may be provided with a charging socket in order to recharge the power supply unit. The electrical circuitry may include a control unit, a memory and sensor. The electrical circuitry is configured to control the operation of the electronic cigarette 2 such as to control the activation of the vaporization and any displayed features and communication to the user. As best seen in FIGS. 5*a* and 5*b*, the proximal end 62 further comprises an atomizer seating 66 configured to receive the atomizer 12 and electrically connect the atomizer 12 to the battery.

Figure 2B:
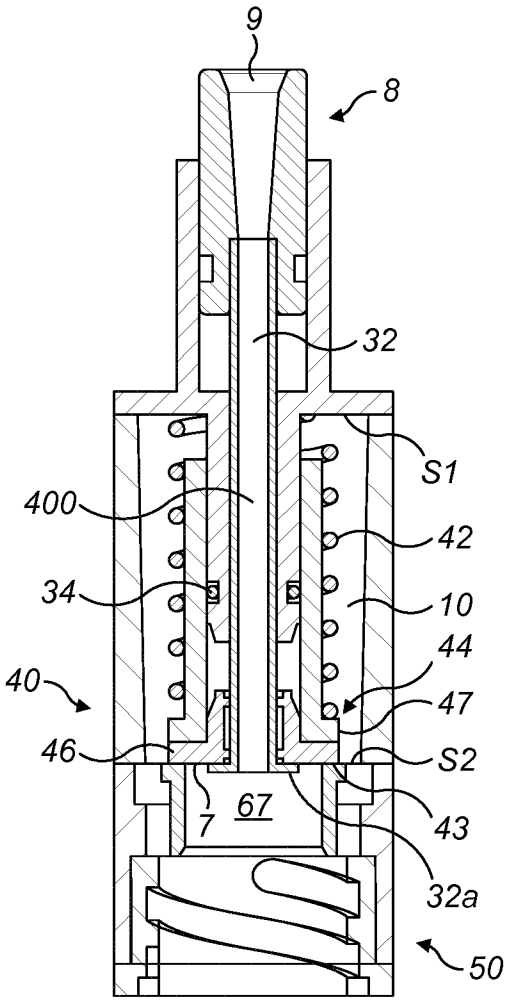
FIGS. 2*b* and 2*c* shows a cross-sectional diagram of a mouthpiece according to an embodiment of the present invention.
Figure 2A:
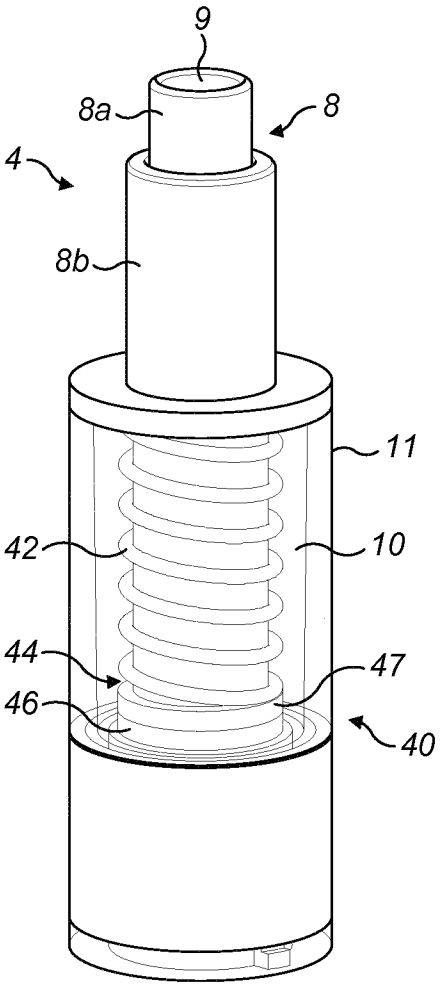
FIG. 2*a* shows a diagram of a mouthpiece according to an embodiment of the present invention.

As illustrated in FIGS. 2*a*, 2*b*, 2*c*, 2*d*, 3*a* and 3*b*, the mouthpiece portion 4 comprises a refillable liquid store 10, a mouthpiece 8 and a vapour flow tube 32 and a valve 40. The vapour flow tube 32 provides a vapour flow channel 400 which extends between an atomizer receiving portion 67 and a vapour outlet 9 in the mouthpiece 8. The mouthpiece portion 4 is provided with a connection portion 50. The connection portion 50 is configured to securely connect with a cooperating connection on the proximal end 62 of the power supply portion 6. The connection portion 50 is located at an opposite distal end of the mouthpiece portion 4 to the mouthpiece 8. As seen in FIGS. 2*a* and 2*b*, the mouthpiece portion 8 can have a fixed mouthpiece portion 8*a* and a movable mouthpiece portion 8*b*. The movable mouthpiece portion 8*b* can be connected to the vapour flow tube 30 which is also movable. However, in preferred embodiments illustrated in e.g. FIGS. 3*a* and 3*b*, the mouthpiece portion 8 is fixed. A fixed mouthpiece portion reduces the risk of debris building up between a movable portion and a fixed portion and is also more comfortable for the user. The vapour flow tube 32 further comprises an abutment surface 32*a*, which enables the mouthpiece to eject an atomizer 12 when received in the atomizer receiving portion 67.

The liquid store 10 comprises a housing 11 having a top surface S1 and a bottom surface S2 located inside the liquid store 10. The top and the bottom surfaces S1, S2 may be arranged in transverse to the longitudinal extension of the electronic cigarette 2. The liquid store 10 is fluidically connected with the atomizer 12 via a liquid opening 7 in the bottom surface S2. The atomizer-receiving portion 67 is located at the connection portion 50 and configured to receive the top portion 12*a* of the atomizer 12.

In order to avoid free flow of liquid through the liquid opening 7 when the mouthpiece portion 4 is disconnected from the power supply portion 6, a valve 40 is provided inside the liquid store 10. The valve 40 comprises a valve closing member 44, a biasing member 42 and a sealing surface 43. The sealing surface 43 can be provided on the bottom surface S2 of the liquid store 10. The biasing member 42 is configured to bias the closing member 44 into a closed position in order to close the liquid opening 7 in the bottom surface S2 of the liquid store 10.

As seen in FIGS. 1*a* to 3*b*, the closing member 44 can be a sleeve 44, which is located around and guided by the vapour tube 32. A sealing member 34 may be positioned between the closing member 44 and the vapour flow tube 32. The sealing member 34 prevents liquid from entering the vapour flow tube 32. The closing member 44 has an axial length that is shorter than the distance between the top surface S1 and the bottom surface S2 of the liquid store 10. The closing member 44 is thus configured to move in the axial direction of the liquid store 10 between an open position and a closed position, i.e. in the direction of the longitudinal extension of the electronic cigarette.

The closing member 44 is provided with a horizontal flange 47 (i.e. perpendicular to the direction of the longitudinal extension of the electronic cigarette) with a diameter larger than the liquid opening 7. The biasing member 42 is encircling the closing member 44. The biasing member 42 has a first end in contact with the horizontal flange 47 and a second end in contact (i.e. biased against) the top surface S1 of the liquid store 10. The biasing member 42 is advantageously a compression spring 44. Alternatively, any biasing member 42 that provides a biasing effect can be used, such as a piece of resilient or elastic material.

The horizontal flange 47 of the valve closing member 44 can optionally be further provided with an elastic seal 46. The elastic seal 46 is fixedly connected to the horizontal flange 47 such that the seal 46 is substantially arranged between the horizontal flange 47 and the bottom surface S2 of the liquid store 10. The seal 46 is configured to both seal against the sealing surface 43 and an upper portion of the atomizer 12. The elastic seal 46 and the flange 47 may be attached to each other by a friction fit and or by cooperating geometries.

Figure 2D:
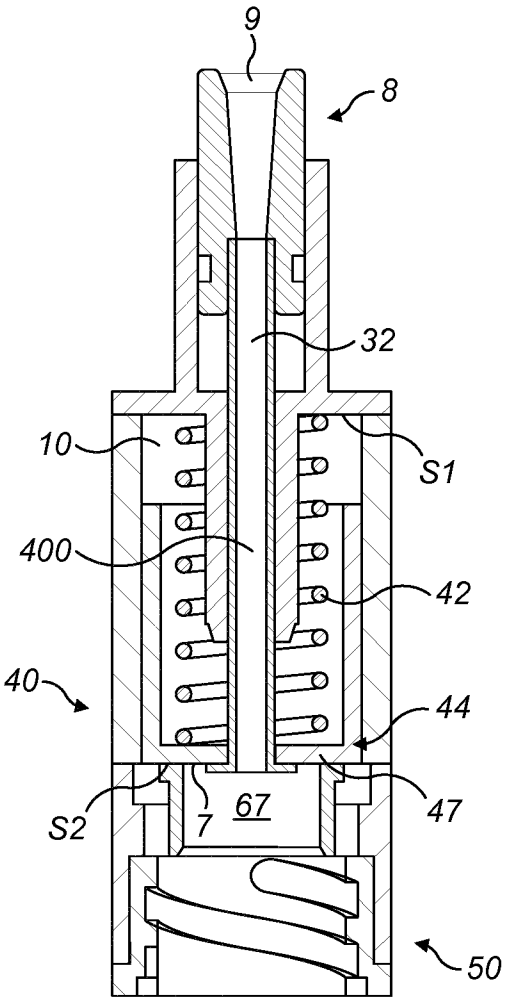
FIG. 2*d* shows a cross-sectional diagram of a mouthpiece according to an alternate embodiment to that of FIG. 2*b*.

As illustrated in FIG. 2*d*, in an alternative embodiment, the closing member 44 can be guided along an inner side of the liquid store. In this case, the flange 47 extends inwardly and seals the liquid opening 7 in the bottom surface of the liquid store 10. The region of the flange 47 not aligned with the liquid opening 7 preferably comprises a liquid permeable portion so as to relieve the pressure created below the flange 47 as it moves downward compressing the liquid in the bottom portion of the liquid store 10. This allows liquid in the bottom portion of the liquid store 10 to be displaced upwardly as the valve closing member 44 moves downward.

Figure 4B:
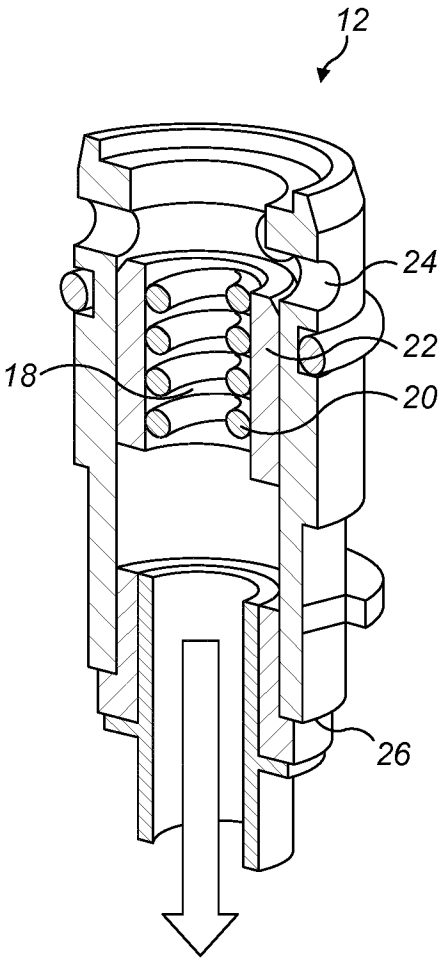
FIG. 4*b* shows a cross-sectional diagram of an atomizer according to an embodiment of the present invention.
Figure 4A:
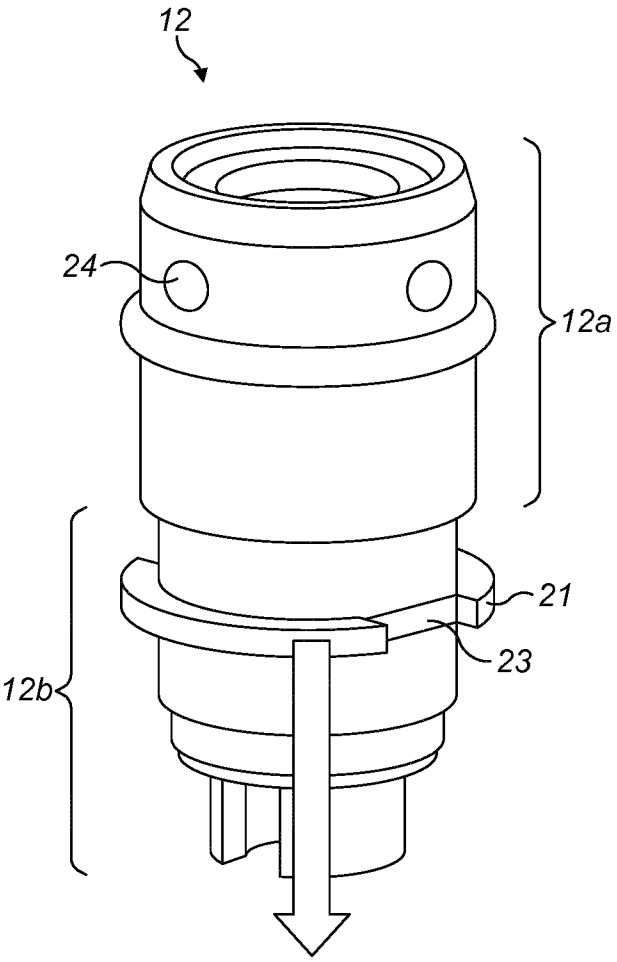
FIG. 4*a* shows a diagram of an atomizer according to an embodiment of the present invention.

As best seen in FIGS. 4*a* and 4*b*, the atomizer 12 may comprise a vaporization chamber 18, a heating element 20 and a fluid transfer element 22 located inside the vaporization chamber 18. The heating element 20 is not limited to any particular type. In the illustrated embodiment, the heating element 20 can be a resistive heating coil 20 comprising e.g. titanium. The heating element 20 can be arranged with its central aperture coinciding with the axial direction of the electronic cigarette 2, i.e. configured as a so called "vertical coil". The vertical coil is advantageous as it fits with the cylindrical shape of the atomizer so as to form a compact atomizer 12. However, a horizontal coil arrangement can also be used.

As best seen in FIGS. 4*a*, 4*b* and 5*a*, the atomizer 12 is provided with a valve engaging portion 12*a* configured to be received into the atomizer-receiving portion 67 in the mouthpiece portion 4 and a seating portion 12*b* configured to be received in the atomizer seating 66 in the power supply portion 6. The valve-engaging portion 12*a* has an axial length exceeding the axial length of the atomizer-receiving portion 67. Hence, the valve-engaging portion 12*a* of the atomizer 12 partially extends into the liquid store 10 when the mouthpiece portion 4, the atomizer 12 and the power supply portion 6 are assembled together.

Figure 2C:
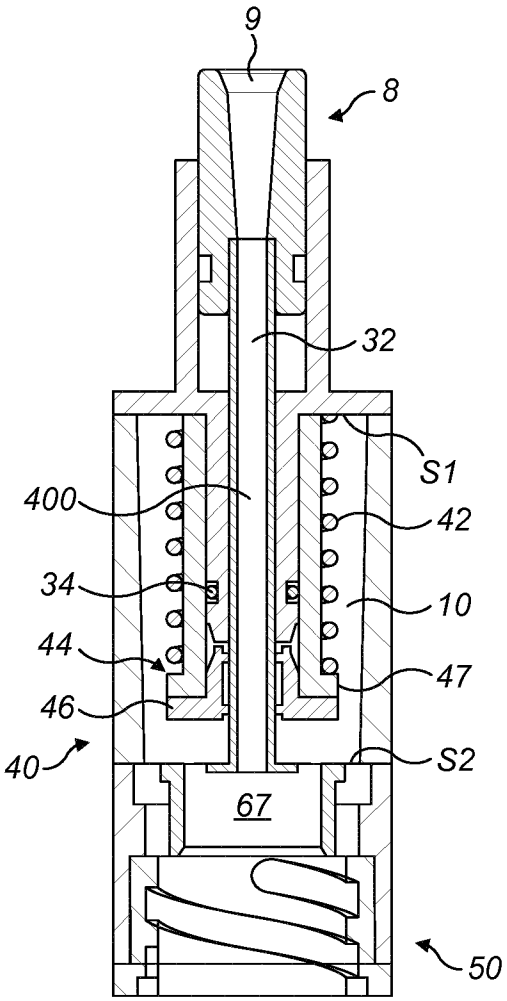

When the atomizer 12 partially extends into the liquid store 10, the valve closing member 44 is released from the sealing surface 43 and positioned at a location further upwards in the axial direction of the mouthpiece portion 4 such that the liquid opening 7 is opened. This opens a liquid communication from the liquid store 10 to the atomizer 12, as shown in FIG. 2*c*. It is noted that the atomizer itself is not shown in FIG. 2*c*, but the valve closing member 44 is displaced vertically in the mouthpiece portion as if an atomizer is present in the atomizer-receiving portion 67.

Figure 3B:
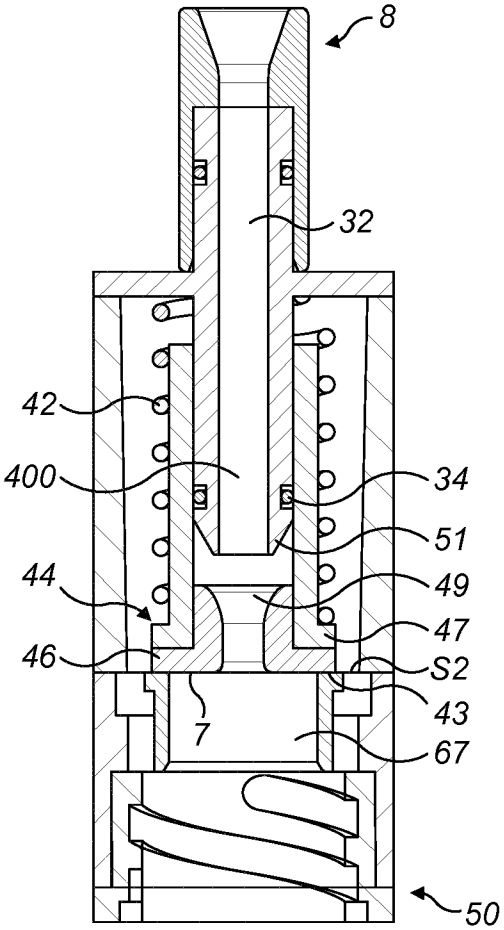
FIG. 3*b* shows a cross-sectional diagram of a mouthpiece according to an embodiment of the present invention.
Figure 3A:
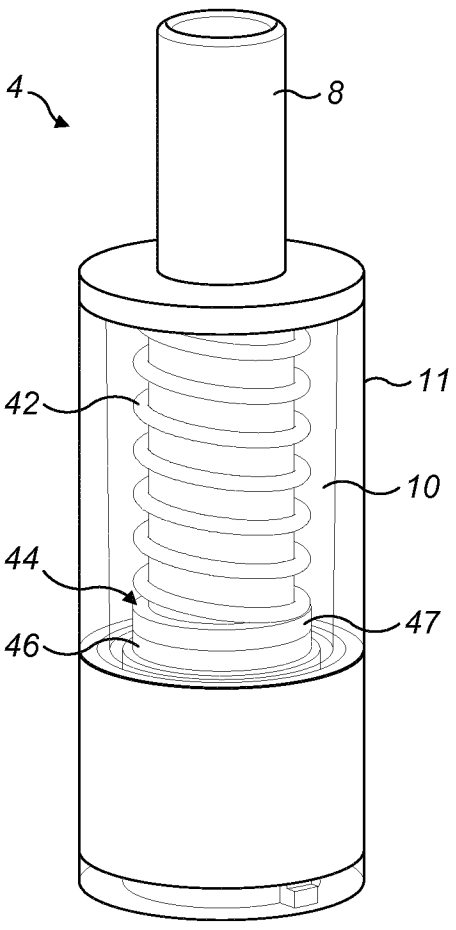
FIG. 3*a* shows a diagram of a mouthpiece according to an embodiment of the present invention.

As illustrated in FIG. 3*b*, the closing member 44 may further comprise a connector 49 configured to sealingly connect the vapour flow tube 32 to the closing member 44. The connector 49 is placed at a distance from a connection end 51 of the vapour flow tube 32. When the atomizer 12 is located inside the atomizer receiving portion 67, the connector 49 abuts against the connection end 51 of the vapour flow tube 32 creating the vapour flow channel 400 between the atomizer and the mouthpiece 8. The connector 49 may advantageously be integrally formed with the seal 46. The connector 49 may also be funnel-shaped such that is surrounds a tapered connection end 51 of the vapour flow tube 40. In this way, the tapered connection end 51 of the vapour flow tube 40 extends into the connector 49 such that a sealed connection is achieved between the vaporisation chamber 18 and the vapour outlet 9.

The atomizer 12 comprises at least one liquid inlet 24 arranged in the proximity of the fluid transfer element 22. Preferably, a plurality of liquid inlets 24 are provided and arranged around the circumference of the atomizer 12. The liquid inlet or inlets 24 are arranged in the atomizer 12 such that when the atomizer 12 partially extends into the liquid store 10 the liquid inlet or inlets 24 are inside the liquid store 10. At least one air inlet 26 is located in the bottom portion of the atomizer 12. The air inlet 26 can be configured as an aperture. Alternatively, the air inlet 26 can be achieved by a clearance or gap in the bottom portion of the vaporization chamber 18.

Figure 6A:
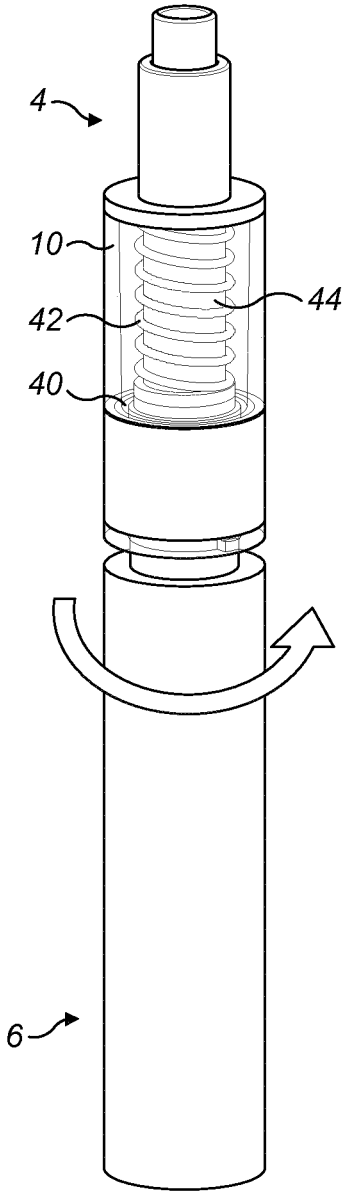
FIG. 6*a* shows a diagram of an electronic cigarette with a closed valve according to an embodiment of the present invention.
Figure 6B:
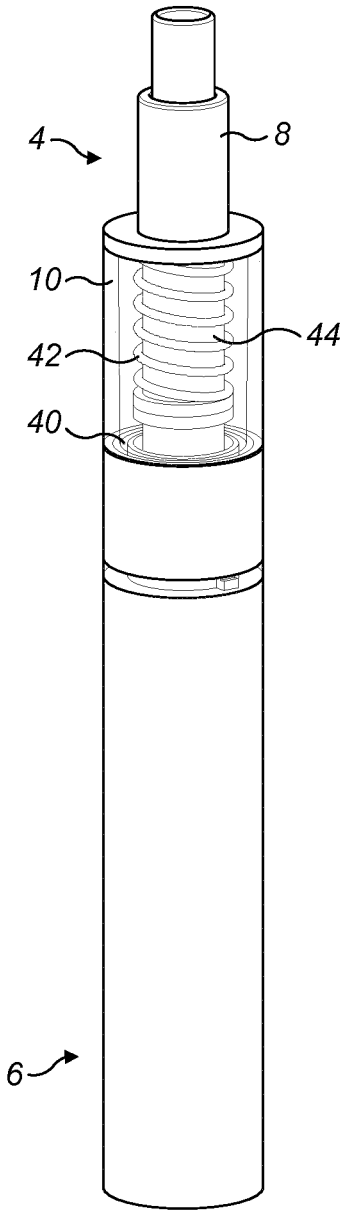
FIG. 6*b* shows a diagram of an electronic cigarette with an open valve according to an embodiment of the present invention.

As illustrated in FIGS. 6*a* and 6*b*, the valve 40 in the liquid store 10 can be opened when an object is applying a force and displacing the valve closing member 44 upwards in the axial direction of towards the mouthpiece 8. As seen in FIG. 6*a*, the valve 40 is closed when the power supply portion 6 is disconnected from the mouthpiece portion 4. As seen in FIG. 6*b*, the valve 40 is opened when the power supply portion 6 with the atomizer attached is attached to the mouthpiece portion 4.

The atomizer 12 is configured to be fixedly connectable to an atomizer seating 66 in the power supply portion 6. This provides an advantage that the atomizer 12 can be reliably electrically connected to the battery. Additionally, it is advantageous if the atomizer 12 stays connected to the power supply portion 6 and does not fall out if the mouthpiece portion 4 is disconnected from the power supply portion 6.

Figure 7B:
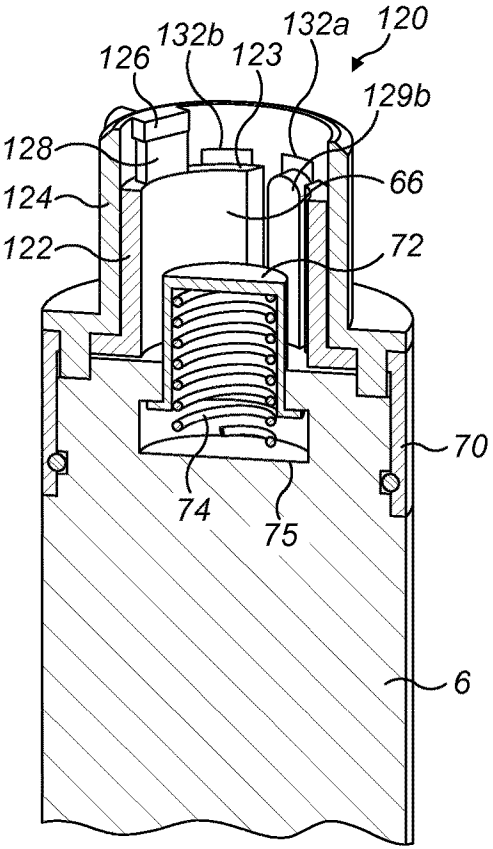
FIGS. 7*b* and 7*c* show cross-sectional diagrams of an atomizer seating with an atomizer lock according to an embodiment of the present invention.
Figure 7A:
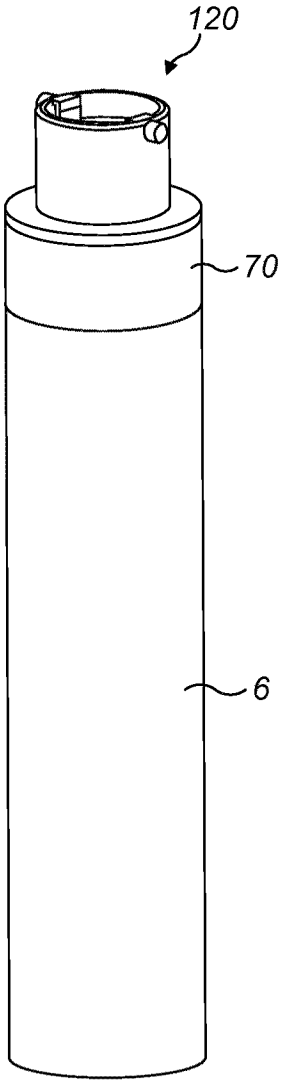
FIG. 7*a* shows a diagram of an atomizer seating with an atomizer lock according to an embodiment of the present invention.
Figure 7D:
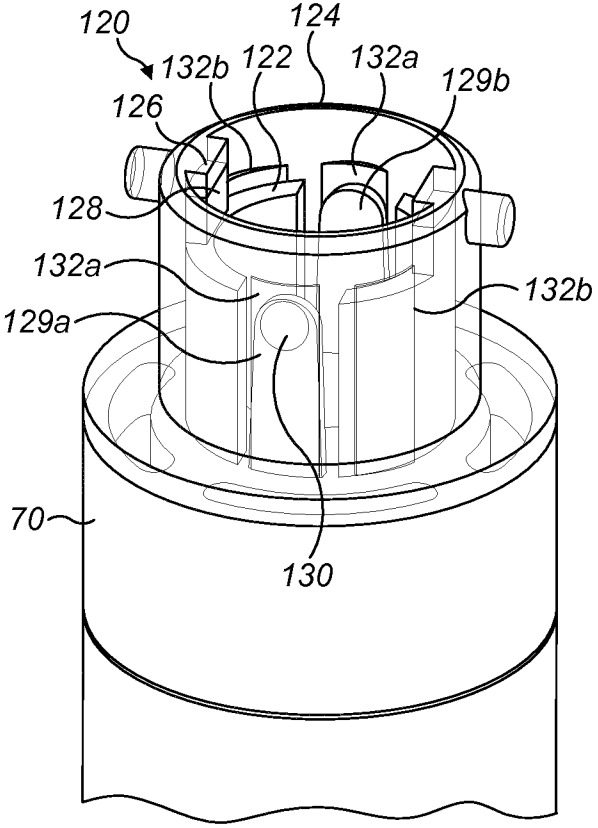
FIG. 7*d* shows a partially transparent diagram of an atomizer seating with an atomizer lock according to an embodiment of the present invention.
Figure 7C:
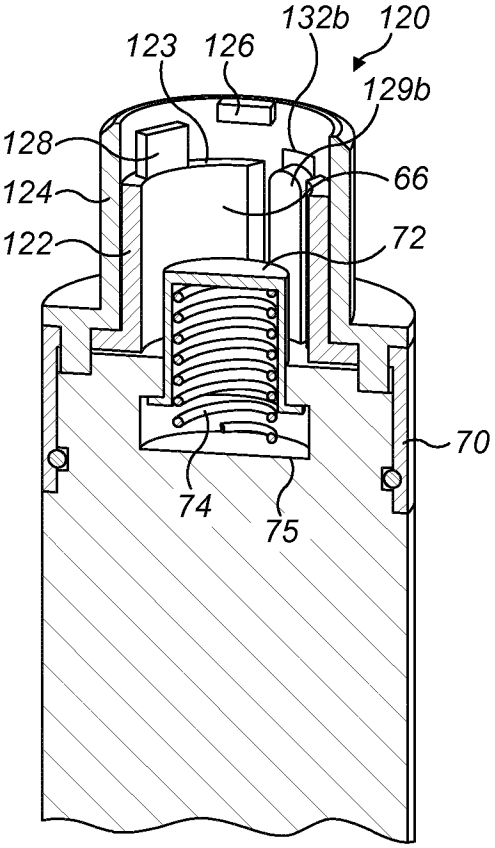

In an embodiment, the atomizer 12 is configured to be locked to the atomizer seating 66 by a relative rotation between the power supply portion 6 and the atomizer 12. As illustrated in FIGS. 7*a* to 7*c*, the atomizer seating 66 in the power supply portion 6 may therefore comprise an atomizer lock 120. The atomizer lock 120 comprises an outer sleeve 124 and an inner sleeve 122 which are rotatable in relation to each other. The outer sleeve 124 comprises a first protrusion 126 extending inwardly in the radial direction of the atomizer seating 66. The inner sleeve 122 comprises a second protrusion 128 extending inwardly in the radial direction of the atomizer seating 66.

Referring to FIGS. 4*a*, 7*b* and 7*c*, the atomizer 12 is provided with an engagement element 21 in the form of an annular ridge 21. The annular ridge 21 is only partially encircling the atomizer 12. This can be done by the ridge not performing a complete circle, or by a cut-out 23 in the annular ridge 21.

The atomizer lock 120 can be changed between a receiving position as illustrated in FIG. 7*b* and a locked position as illustrated in FIG. 7*c*. In the receiving position, the atomizer 12 can be inserted and removed from the atomizer seating 66 by an axial movement. This is possible because the first 126 and the second protrusions 128 are aligned with each other so as to form a "guide rail" in the axial direction of the atomizer seating 66. The atomizer 12 can therefore be introduced into the atomizer seating 66 by aligning the cut-out 23 in the annular ridge 21 with the first 126 and second protrusions 128.

The inner sleeve 122 further comprises a support surface 123 positioned such that the annular ridge 21 of the atomizer can rest against the support surface 123. The support surface 123 is thus configured to position the atomizer 12 at a correct depth in the atomizer seating 66.

In the locked position, as shown in FIG. 7*c*, as a consequence of the inner sleeve 122 and outer sleeve 124 having been rotated with respect to one another, the first protrusion 126 and second protrusion 128 are brought out of alignment with one another. The first protrusion 126 can therefore be arranged above the annular ridge 21 of the atomizer 12 when it is located in the atomizer seating 66, thereby locking the atomizer 12 in the atomizer seating 66. By rotating the first protrusion 126 and second protrusion 128 back into alignment the protrusions 126, 128 can pass through the cut-out 23 of the annular ridge thereby unlocking and releasing the atomizer 12 from the atomizer seating.

The inner sleeve 122 may further comprise a pair of resilient tongues 129*a*, 129*b*. The tongues 129*a*, 129*b* are biased radially outwards in the radial direction of the atomizer seating 66. The outer sleeve 124 further comprises slots 132*a*, 132*b* configured to receive the tongues 129*a*, 129*b*. When the tongues 129*a*, 129*b* are received into the slots 132*a*, 132*b*, the inner sleeve 122 and the outer sleeve 124 are rotationally locked in relation to each other. When the first protrusion 126 and the second protrusion 128 are in alignment, the tongues 129*a*, 129*b* are positioned in the first slots 132*a*, and when the first protrusion 126 and second protrusion 128 are out of alignment the tongues 129*a*, 129*b* are received in the second slots 132*b*. Hence, when the atomizer lock 120 is in an open position and when the atomizer lock 120 is in a closed position, the tongues 129*a*, 129*b* are received inside the slots 132*a*, 132*b*. This enables the atomizer lock 120 to provide a bi-stable operation and a haptic feedback to the user such that it becomes clear when the atomizer 12 is locked and released from the atomizer seating 66. The placement of the tongues 129*a*, 129*b* in the first slots 132*a* and the second slots 132*b* therefore respectively defines the aligned and misaligned positions of the first protrusion 126 and the second protrusion 128 with respect to one another by rotationally locking the inner sleeve 122 and the outer sleeve 124 in place until a sufficient torque is applied to move the tongues 129*a*, 129*b* from one slot to the other. The resilient tongues 129*a*, 129*b* may further comprise a convex protrusion or a bulging portion 130. The convex protrusion 130 is configured to guide the resilient tongues 129*a*, 129*b* into and out from the slots 132*a*, 132*b*. The resilient tongues are only locked inside the slots 132*a*, 132*b* until a sufficiently large torque is applied to the inner sleeve 122.

The torque can be applied to the inner sleeve by manually rotating the atomizer 12. This is because the atomizer 12 is coupled to the inner sleeve 122 via the protrusion 128 in the inner sleeve 122.

Alternatively, in an embodiment illustrated in FIGS. 7*a* to 7*d*, the power supply portion 6 comprises an actuator 70 in the form of a rotating ring or sleeve 70 and is located on the exterior housing of the power supply portion 6. The rotating ring 70 is operationally connected to the inner sleeve 122 such that they rotate in unison. The actuator 70 can thus be used to lock in the atomizer 12 into the atomizer seating 66.

It is advantageous to provide a biased abutment surface 72 in the atomizer seating 66. The biased abutment surface 72 can be configured as an electrical terminal. The biased abutment surface 72 is thus biased against a corresponding electrical connection portion of the atomizer 12.

The biased abutment surface 72 is coupled to a biasing member 74 such as a compression spring. The biasing member 74 has an upper end in contact with the biased surface 72 and a lower end in contact with a stationary surface 75 inside the power supply portion 6. In the embodiment illustrated in FIGS. 7*b* and 7*c*, the stationary surface 75 remains in the same position within the power supply portion 6. The biased surface 72 is configured to move between an ejection position and retracted position. The biased surface 72 can be a surface of a cylinder. The cylinder has a closed end, configured as the biased surface and an open end through which the spring exits. The open end of the cylinder can be provided with a circumferential flange which extends outwardly in the radial direction of the biased abutment member.

When the atomizer 12 is arranged in the atomizer seating 66, such that annular ridge 21 of the atomizer rests against the support surface 123, the bottom of the atomizer displaces the biased abutment surface 72 downward into the power supply portion thereby compressing to the biasing member 74 from an equilibrium state (i.e. uncompressed or at rest state) to a compressed state between the biased surface 72 and the stationary surface 75. As previously described, the first protrusion 126 locks the atomizer 12 in place in the atomizer seating 66 when the first protrusion 126 and second protrusion 128 are out of alignment; this maintains the compression applied to the biasing member 74.

The biased abutment surface 72 acts as an ejection mechanism to the atomizer 12 when the atomizer lock 120 is in an open position, such that the atomizer 12 can be released from the atomizer seating 66 without having to manually touch the atomizer 12. This avoids the user from being in contact with liquid when replacing a used atomizer 12.

It is preferable to replace the atomizer 12 after certain durations of use. When the atomizer 12 has been used, it can sometimes be covered with vaporization liquid. It is therefore advantageous if the user can discard the atomizer 12 without touching it. The biased abutment surface 72 is also configured to apply a biasing force onto the bottom portion 13 of the atomizer 12.

The biased abutment surface 72 therefore urges the atomizer 12 out from the atomizer seating 66. An atomizer ejection mechanism is therefore provided by the combination of the atomizer lock 120 and the biased abutment surface 72. The actuator 70 (rotating sleeve) is rotated to release/unlock the atomizer 12 from the atomizer seating 66 and the biased abutment surface ejects the atomizer 12 from the atomizer seating 66. That is to say, when the first protrusion 126 and second protrusion 128 are brought into alignment, such that the first protrusion 126 is no longer locking the atomizer 12 in the atomizer seating 66, the biasing applied by the biasing member 74 forces the atomizer 12 from the atomizer seating 66 as the compression is released and the biasing member 74 moves from a compressed state to an equilibrium state.

To reduce the risk of leakage, it is also advantageous to be able to close the liquid flow from the liquid store 10 to the atomizer 12 when the mouthpiece portion 4 is connected to the power supply portion 6. For instance, when travelling on an airplane, the low pressure in the ambient air at a high altitude will expand the air inside the liquid reservoir in response to an increase in altitude. This leads to the liquid being expelled with a greater force from the liquid store 10 to the atomizer 12. At the same time, less resistance is provided by the surrounding air, wherefore the liquid inside the liquid store 10 can more easily leave the liquid store 10 as the flow resistance is reduced at high altitude.

Referring back to FIG. 2*a*, the liquid store 10 is fluidically connected to the vapour outlet 9 in the mouthpiece 8 via the atomizer 12 and vapour tube 30. Hence, liquid may leak into the vapour flow channel and may potentially also leak out from the mouthpiece 8. Even if liquid only leaks into the vapour tube 30, it can reach the user as unvaporized liquid as the user inhales from the mouthpiece 8. Additionally, the fluid transfer element in the atomizer 12 can get oversaturated and the electronic cigarette may form projections of unvaporized liquid next time when the electronic cigarette 2 is being used.

As illustrated in FIGS. 8*a* to 8*c* and 9*a* to 9*c*, another embodiment of a leakage prevention system can be provided. The mouthpiece portion 4 is configured in a similar way as the embodiment previously discussed with regard to the valve 40. However, the proximal end of the power supply portion 6 is different, as will be described subsequently.

The leakage prevention system can easily be provided with the components of the valve 40 of the mouthpiece portion 4 and the atomizer lock 120. The leakage prevention system is based on a realization that the valve 40 is opened when the valve engaging portion of the atomizer 12*a* is located inside the liquid store 10. When the valve engaging portion of the atomizer 12*a* is located in the liquid store 10, the valve closing member 44 is released from the sealing surface 43 so that the outlet 7 is opened. Hence, the valve 40 is closed when the vaporizer 12 is removed from engagement with the valve closing member 44 of the liquid store 10.

Rather than removing the mouthpiece portion 4, however, the atomizer 12 can be retracted into the power supply portion 6 so that it no longer extends into the liquid store 10. Hence, the valve 40 can be released from the atomizer 12 and closed without disconnecting the mouthpiece portion 4 from the power supply portion 6.

The proximal portion of the power supply portion 6 comprises an inner sleeve 222 and an outer sleeve 224. The outer sleeve 224 further comprises an actuator 70 in the form of a rotatable sleeve 70. The rotatable sleeve 70 is operationally coupled to the inner sleeve 222. For instance, the rotatable sleeve 70 is operationally coupled to the inner sleeve 222 through a follower pin 71 located on the inner side of the actuator 70 and a thread 73 located on the outer sleeve 224.

As seen in FIGS. 8*a* to 8*c*, 9*a* to 9*c* and 12*a* to 12*c* the electronic cigarette 2 may be further provided with a guiding arrangement 500, configured to axially displace the inner sleeve 222 between an extended position and a retracted position.

In the illustrated embodiment, the guiding arrangement 500 comprises the axially displaceable inner sleeve 222, a pin 71 with a first portion located inside an axial groove 93 and a second portion located inside a guiding thread 95 on the inner side of the actuator 70'. Hence, the guiding arrangement 500 is configured to translate a rotational displacement of the actuator 70 to a linear (i.e. axial) displacement of the inner sleeve 222.

The inner sleeve 222 is thus axially moveable inside the power supply portion 6 between an extended position and a retracted position.

When the actuator 70 is rotated, the pin forces the threaded sleeve in a first direction or a second direction such that the axial position of the atomizer 12 is changed. The atomizer 12 can thus be positioned such that it extends into the liquid store, or that it is moved so that it is not actuating the valve 40 which then remains closed.

However, in a non-illustrated embodiment, it is also possible that the actuator 70 is linearly displaceable in the axial-longitudinal direction of the power supply portion and configured to move the inner sleeve in the axial direction.

Figure 8C:
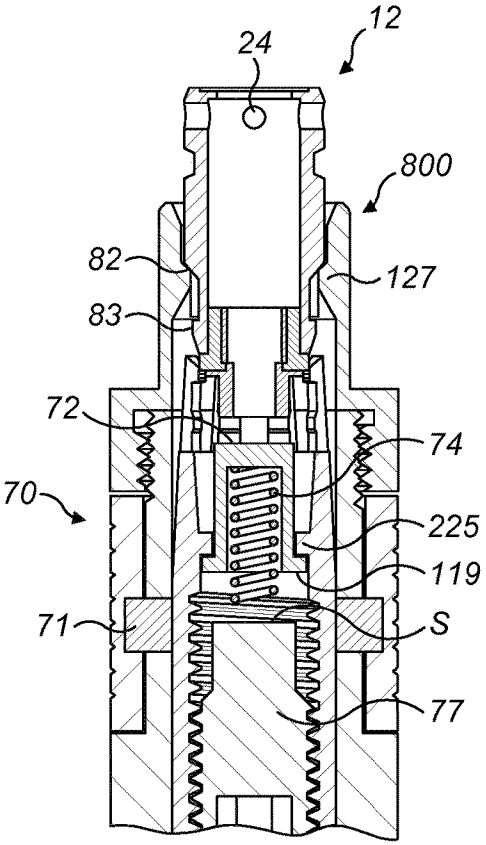
FIGS. 8*a*-8*c* show cross-sectional diagrams of a leakage prevention system according to an embodiment of the present invention.
Figure 8B:
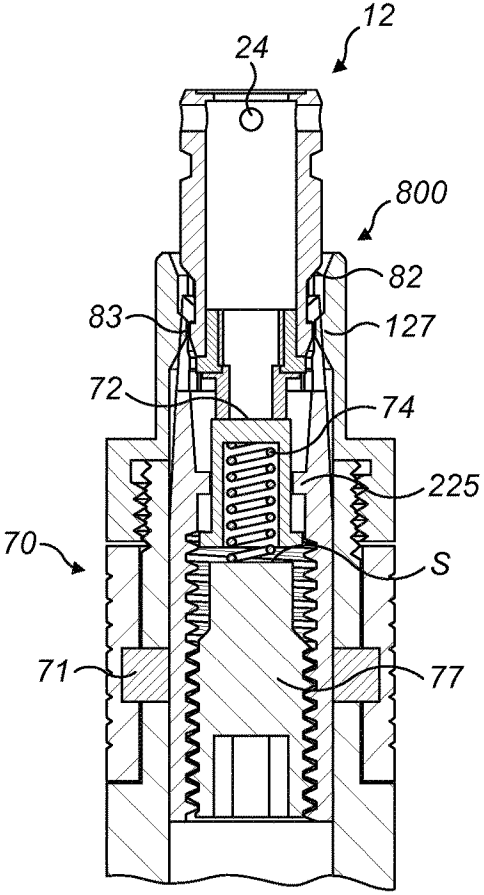

In the extended position (i.e. in an operating position), as shown in FIG. 8*b*, the atomizer 12 is partially extending into the liquid reservoir 10 such that a fluidic connection between the liquid store 10 and the atomizer 12 is established. In the retracted position, as illustrated in FIG. 8*c*, the atomizer 12 is retracted into the body of the power supply portion 6 such that the atomizer 12 is no longer abutting against the valve closing member 44. In the retracted position, the liquid outlet 7 in the bottom of the liquid store 10 is closed. Hence, as the atomizer is connected to the inner sleeve 222, the axial displacement mechanism also enables the atomizer 12 to move between an extended position and a retracted position.

Figure 8A:
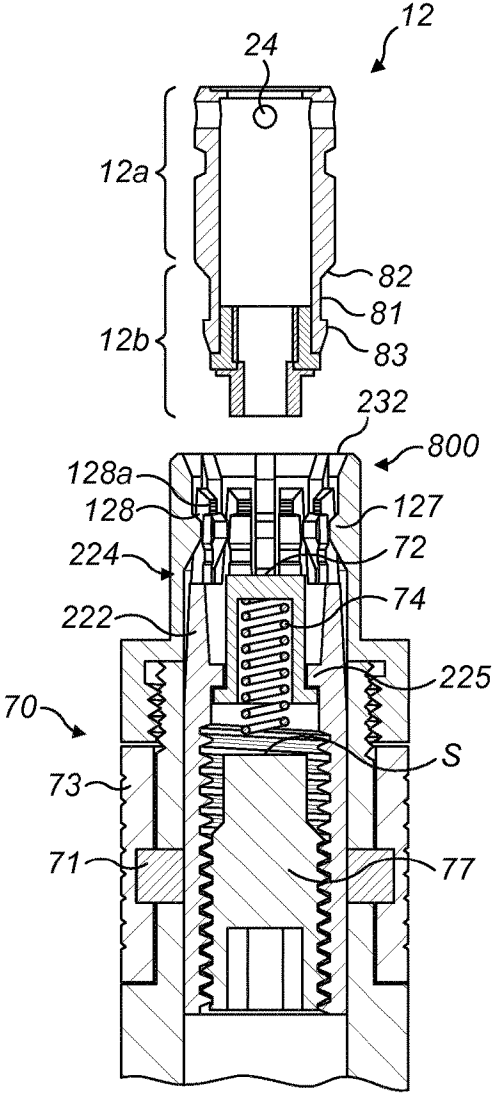
Figure 9C:
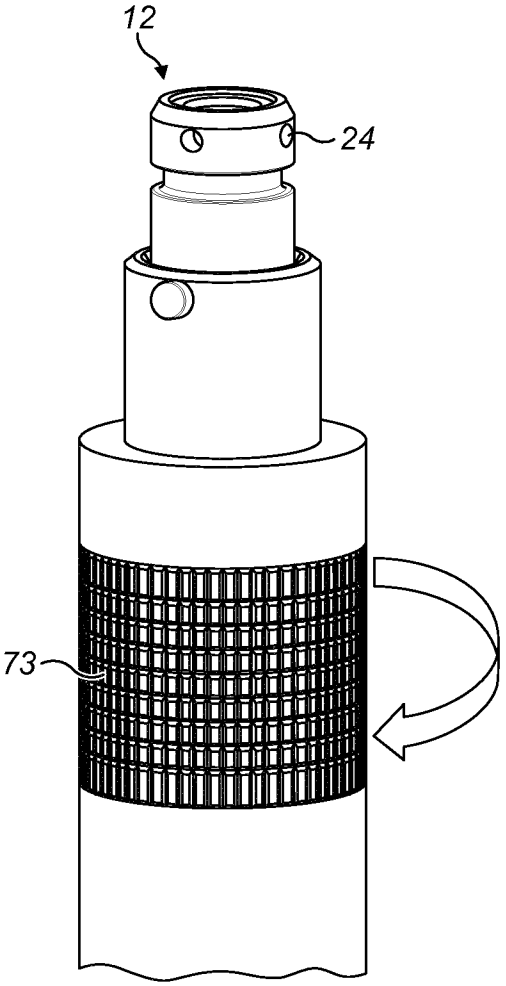
FIGS. 9*a*-9*c* show diagrams a leakage prevention system according to an embodiment of the present invention.
Figure 9B:
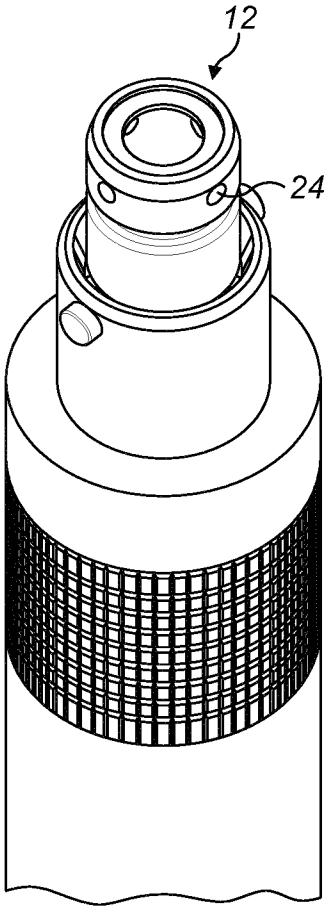
Figure 9A:
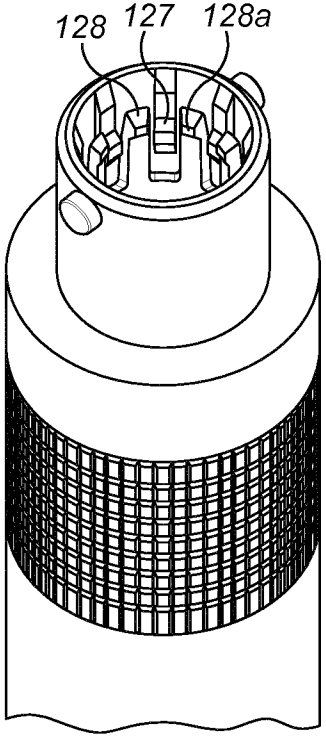
Figure 10A:
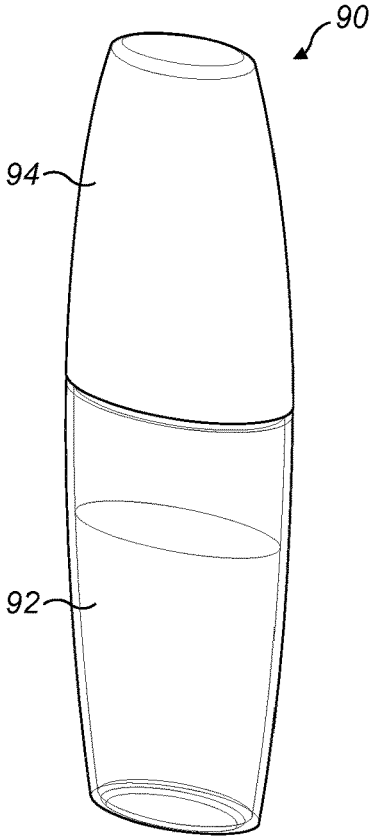
FIGS. 10*a* and 10*b* show diagrams of a refilling bottle according to an embodiment of the present invention.
Figure 10B:
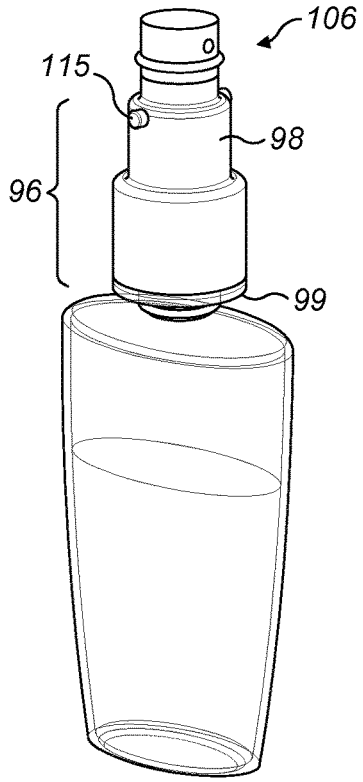
Figure 10C:
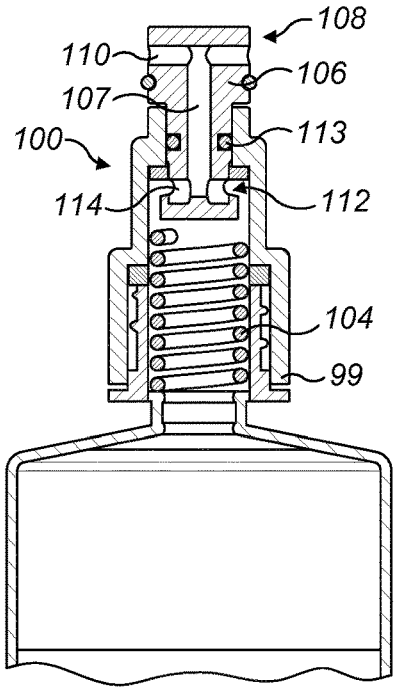
FIG. 10*c* is a cross-sectional view of a refilling bottle in an embodiment of the present invention.
Figure 10D:
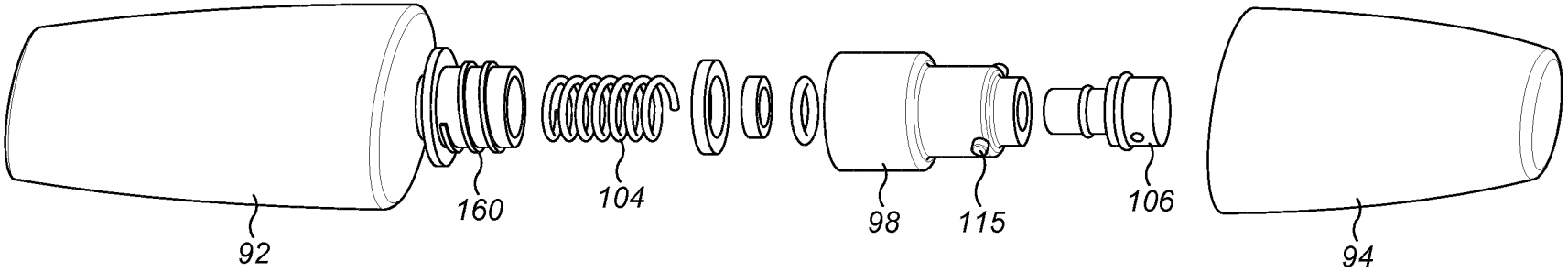
FIG. 10*d* shows an exploded view of a refilling bottle according to an embodiment of the present invention.
Figure 11D:
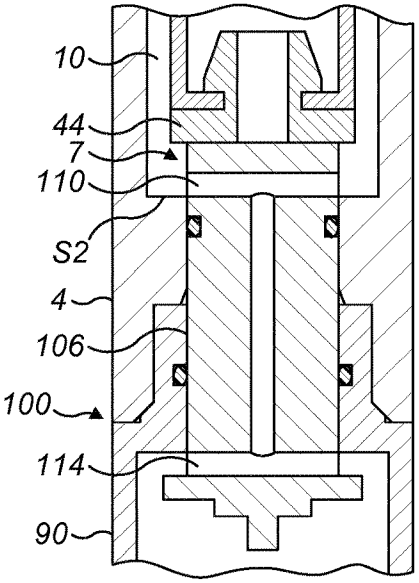
FIG. 11*d* shows a cross-sectional diagram of the interaction between a refilling bottle and mouthpiece portion of an electronic cigarette according to an embodiment of the present invention in which a liquid store of the mouthpiece portion and a liquid tank of the refilling bottle are both open.
Figure 11C:
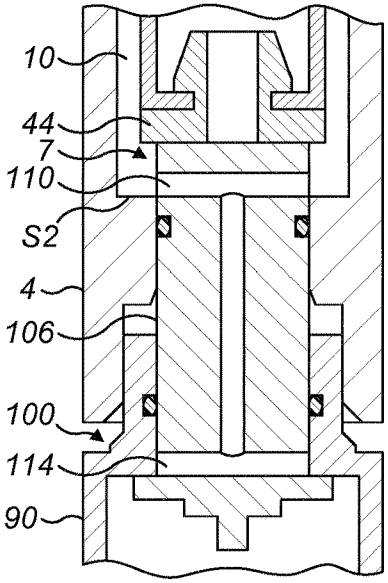
FIG. 11*c* shows a cross-sectional diagram of the interaction between a refilling bottle and mouthpiece portion of an electronic cigarette according to an embodiment of the present invention in which a liquid store of the mouthpiece portion is open and a liquid tank of the refilling bottle is closed.
Figure 11B:
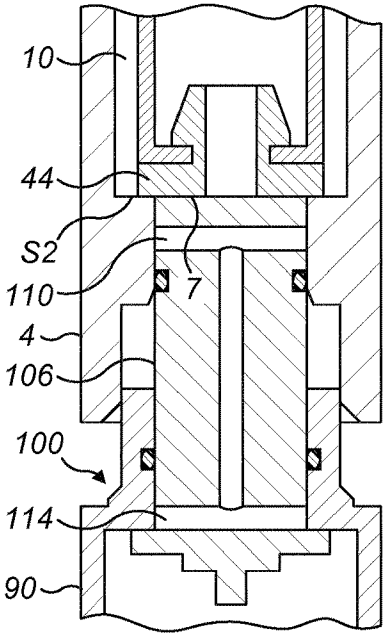
FIG. 11*b* shows a cross-sectional diagram of the interaction between a refilling bottle and mouthpiece portion of an electronic cigarette according to an embodiment of the present invention in which a liquid store of the mouthpiece portion and a liquid tank of the refilling bottle are both closed.
Figure 11A:
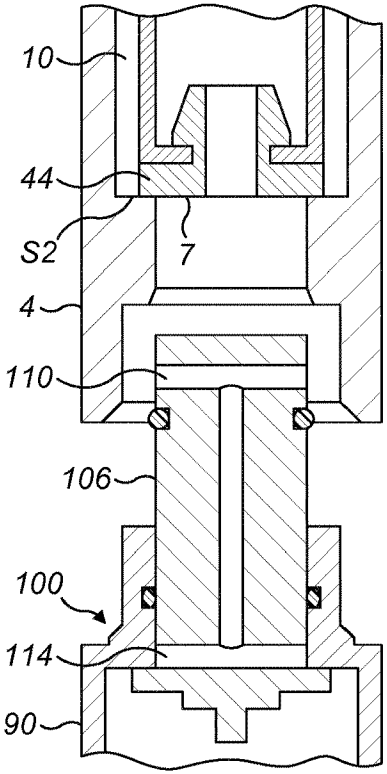
FIG. 11*a* shows a cross-sectional diagram of the interaction between a refilling bottle and mouthpiece portion of an electronic cigarette according to an embodiment of the present invention in which a liquid store of the mouthpiece portion and a liquid tank of the refilling bottle are both closed.
Figure 12A:
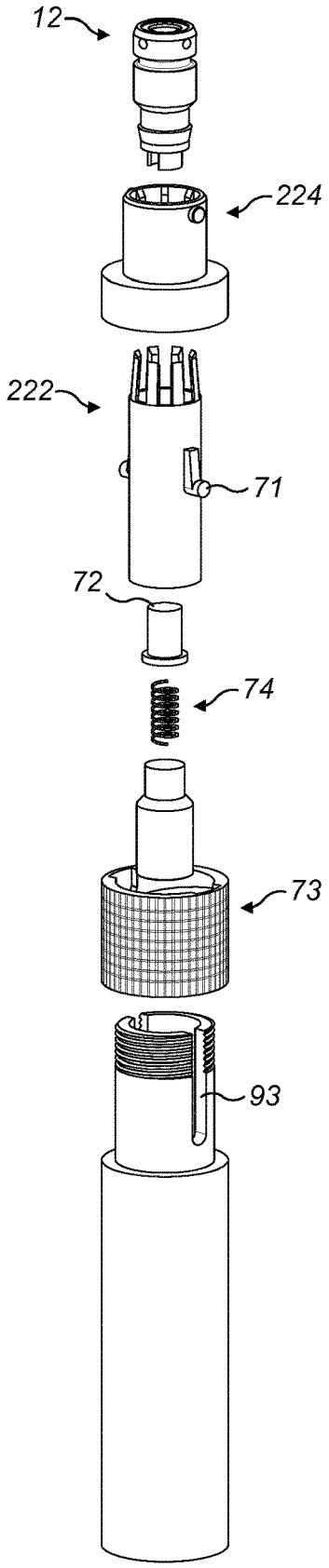
FIG. 12*a* is an exploded view of an electronic cigarette in an embodiment of the present invention.
Figure 12B:
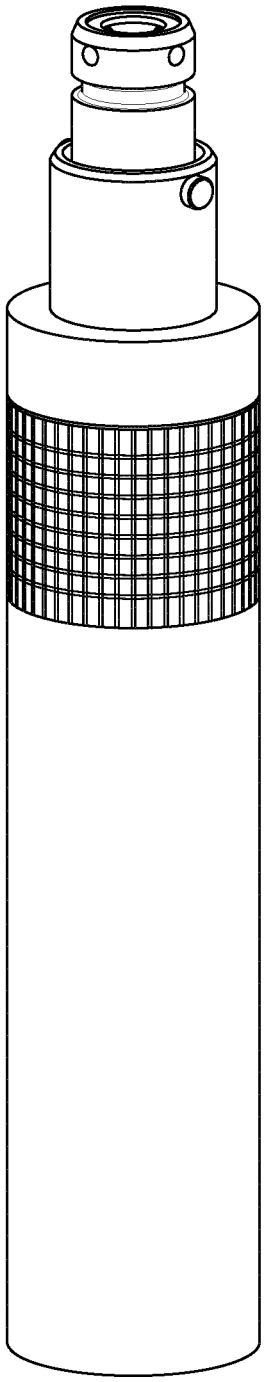
FIG. 12*b* is a perspective view of the electronic cigarette shown in FIG. 12*a*, when assembled.
Figure 12C:
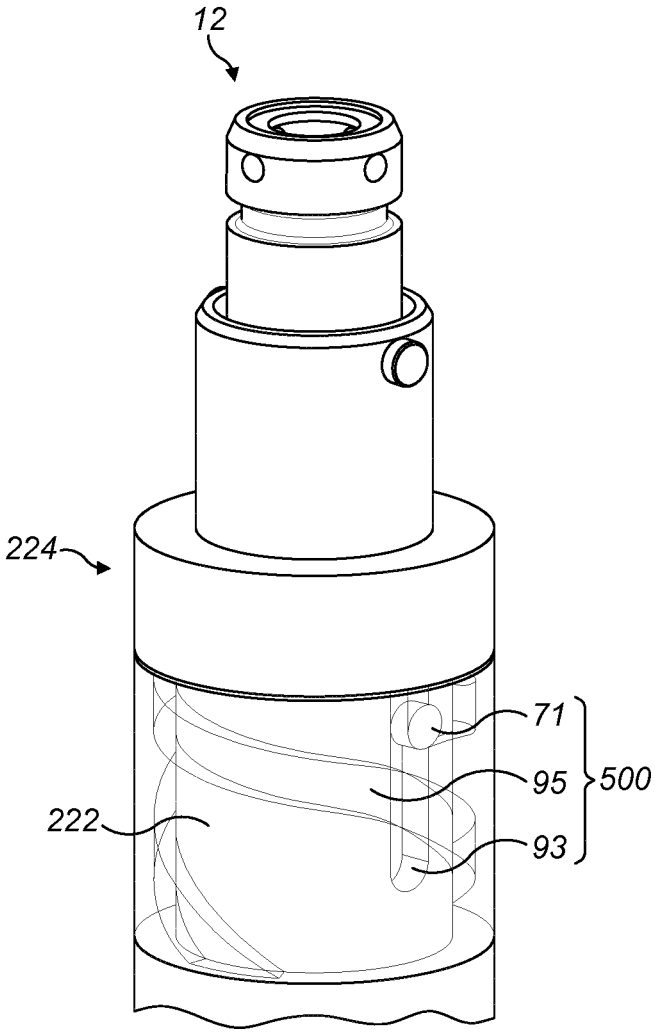
FIG. 12*c* is a detailed perspective view of the electronic cigarette shown in FIG. 12*b* showing the atomiser and a guiding arrangement.

In the illustrated embodiment shown in FIGS. 8*a* to 8*c*, the engagement element 81 on the atomizer 12 can be in the form of an annular groove 81, the annular groove 81 defining an upper edge 82 toward the end of the atomizer 12 comprising the valve engaging portion 12*a* and a lower ledge 83 toward the end of the atomizer comprising the seating portion 12*b*. The inner sleeve 122 is provided with a connector 128 in the form of a clasp 128. In a preferred embodiment, a plurality of clasps 128 are provided. A plurality of clasps 128 provides a good connection between the clasps and the atomizer 12 such that the atomizer 12 can be securely connected to the inner sleeve 122. The clasps 128 are configured as resilient elongate members with projections 128*a* extending radially inward to sleeve at the atomizer receiving end. The clasps elastically deform over the lower edge 83 of the atomizer 12 when the atomizer 12 is pushed into the inner sleeve 222 such that the projections 128*a* are positioned in the annular groove 81 of the atomizer 12, abutting the lower edge 83, thereby clasping the atomizer in the inner sleeve 222 so that the atomizer 12 is engaged in the inner sleeve 222. The outer sleeve 124 is provided with axial slots 232 configured to guide the clasps 128 in the axial direction of the power supply portion 6. The electronic cigarette 2 in the embodiments of FIGS. 8*a* to 8*c* and 9*a* to 9*c* may also be provided with an atomizer ejection mechanism 800 by the combination of the clasps 128 which lock or retain the atomizer to the inner sleeve 222, and a movable biased abutment surface 72. In this way, the atomizer ejection mechanism 800 is configured to selectively retain/lock the atomizer 12 and eject the atomizer 12.

The biased abutment surface 72 is biased by a biasing member 74, a retaining flange 225 and a stationary biasing surface S. The biasing member 74, which can be a compression spring, is arranged in-between the biased surface 72 and the stationary biasing surface S. As the distance between the biasing surface 72 and the stationary biasing surface S varies, the level of compression of the biasing member 74 varies.

As seen in FIG. 8*a*, when the atomizer 12 is pushed into the inner sleeve 222, a bottom portion of the atomizer 12 can engage the biased abutment surface 72. The inner sleeve 222 can engage the biased abutment surface 72 via the flange 225 such that it can be retracted with the inner sleeve 222 into the body of the power supply. The flange 225 enables the biased abutment surface 72 to move in unison with the inner sleeve 222 as it is retracted into the power supply portion 6.

As is presented in FIG. 8*a*, before the atomizer 12 is engaged in the inner sleeve 222, the biasing member 74 is uncompressed. The biased abutment surface 72 is not pushed against the biasing surface S and the biasing member 74 is free from compression. However, when the atomizer 12 is pushed into and engaged in the inner sleeve 222 in an operating mode, as presented in FIG. 8*b*, the biased abutment surface 72 is pushed toward the biasing surface S and a compression is applied to the biasing member 74 between the biased abutment surface 72 and the biasing surface S.

As is presented in FIG. 8*c*, the inner sleeve 222 can be retracted into the outer sleeve 224. The inner sleeve 222 clasps the atomizer 12 and so when the inner sleeve 222 is retracted it retracts the atomizer 12 into the outer sleeve, away from the mouthpiece portion. Consequently, the valve engaging portion 12*a* of the atomizer 12 no longer engages the valve closing member 44 of the mouthpiece portion 4, and the biasing member 42 of the mouthpiece portion 4 biases the closing member 44 to the closed position, thereby closing the liquid opening of the liquid store 10 of the mouthpiece portion 4. As the atomizer 12 is retracted, the bulges 127 of the outer sleeve 224 engage the upper ledge 82 of the annular groove of the atomizer 12 thereby providing a stopping position such that the atomizer cannot be retracted further. The abutment of the upper ledge 82 against the bulges 127, when coupled with the further retraction of the inner sleeve 222, causes the clasps 128 to elastically deform over the lower ledge 83 when a great enough force is applied thereby releasing the atomizer 12 from the inner sleeve 222. When the projections 128*a* of the clasps 128 move over the lower ledge 83 the movement creates a haptic feedback to the user which indicates that the valve in the electronic cigarette is closed as the valve engaging portion 12*a* of the atomizer 12 has been retracted from the closing member of the mouthpiece. As the inner sleeve 222 moves further into the outer sleeve 224, the biasing surface S is no longer in contact with the biasing member 74, whereby the biased abutment surface 72 no longer applies an expelling force to the atomizer 12. The atomizer 12 is disengaged from the inner sleeve 222 before the biasing surface S has retracted enough to suitably remove the compressive force from the biasing member 74. This can be achieved either by the inner sleeve 222 retracting before the biasing surface S arranged on element 77 retracts, or by the biasing surface S arranged on element 77 retracting simultaneously but more slowly than the inner sleeve 222.

If the mouthpiece portion is removed, and the inner sleeve 222 is retracted and the consequent abutment of the upper ledge 82 against the bulges 127 causes the clasps 128 to elastically deform over the lower ledge 83, thereby disengaging the atomizer 12 from the inner sleeve 222, and atomizer ejection is achieved. As noted, the atomizer 12 disengages from the inner sleeve 222 before or at the same time the biasing surface disengages from the biasing member such that the biasing member is still under a compressive force when the atomizer is disengaged. As a consequence of the atomizer disengaging from the inner sleeve the biasing force applied by the biasing member 74 to the biased abutment surface 72 by the compression is released so as to eject the atomizer 12 from the power supply portion. Advantageously, the flange or stationary surface 225 engages the biased abutment surface during the ejection to prevent the biased abutment surface itself from also being ejected.

As illustrated in FIG. 8*c*, the biased abutment surface 72 can be released from engagement with the bottom portion of the atomizer 12 when the inner sleeve 222 is in a retracted position. The biased surface can be shaped as a cylinder having a closed end configured as the biased surface and an open end through which the spring exits. The biased abutment surface 72 has its lower end abutting against a stationary surface 225. The stationary surface remains in the same position within the power supply portion 6. The open end of the cylinder can be provided with a flange. The cylinder is configured to move in the axial direction in unison with the inner sleeve 122. The inner sleeve may therefore be provided with an abutment 225 located vertically above the cylinder flange portion. When the atomizer 12 is placed in a fully retracted position, the biased abutment surface 72 is retracted and is no longer in contact with the bottom portion of the atomizer. The biased abutment surface 72 can be configured as an electrical terminal. The terminal is thus biased against a corresponding electrical connection portion of the atomizer 12 when the inner sleeve 222 is extended outwardly from the outer sleeve 224. Advantageously, when the inner sleeve is retracted, and the biased abutment surface 72 is no longer is in contact with the bottom portion of the atomizer, the atomizer is electrically disconnected from the electrical terminal thereby ensuring the atomizer is not inadvertently switched on when not in use.

To re-engage the atomizer 12 with the inner sleeve 222, the inner sleeve 222 can be extended upwards against the atomizer 12 such that the clasps 128 are extended outwardly from the outer sleeve 224 such that the clasps re-engage with the atomizer 12 in the annular groove 81. The valve engaging portion 12*a* of the atomizer 12 abuts the mouthpiece portion 4 and an opposing force is applied to the atomizer 12; this leads to the projections 128*a* of the clasps 128 moving over the lower ledge 83 into the annular groove 81 of the atomizer such that the atomizer 12 is again held by the clasps 128. When the projections 128*a* of the clasps 128 move back over the lower ledge 83 the movement creates a haptic feedback to the user which indicates that the valve in the electronic cigarette is again opened as the valve engaging portion 12*a* of the atomizer 12 is again extended so as to urge the closing member of the mouthpiece to the open position.

The inner sleeve 222 can be moved further in the axial direction in relation to the outer sleeve 224 such that the biasing force from the biased surface 72 exceeds the radial biasing force of the clasps 128. Hence, when the biasing force from the ejector surface exceeds the radial biasing force of the clasps 128, the atomizer 12 is ejected from the atomizer seating 66. The inner sleeve 122 is thus configured to grasp the atomizer 12, when the clasps 128 engage the lower ledge 83 of the atomizer 12, and move the atomizer 12 in the axial direction further into the power supply portion 6.

It is also advantageous to provide a leakage reduction system for refilling the liquid store 10 which is configured to interact with the valve 40 of the mouthpiece portion 4. FIGS. 10*a* to 10*d* illustrate a refill bottle 90 configured to be used together with the previously described mouthpiece portion 4 of the present invention. The refill bottle 90 comprises a liquid reservoir 92 a liquid transfer arrangement 96. The refill bottle 90 may also comprise a cap 94 to protect the liquid transfer arrangement 96. The liquid reservoir 92 is preferably made from a flexible material such that it can be squeezed to expel liquid. The present refill bottle 90 enables to balance the volume of liquid and air inside the liquid store. As illustrated in FIGS. 10*a* to 10*d*, the liquid transfer arrangement 96 comprises a housing 98, a reservoir connection portion 99 and a refilling valve 100. The refilling valve 100 has a plunger 106 axially moveable within the housing 98. The liquid transfer arrangement 96 can be fixedly connected to a refill bottle 90 through e.g. an ultrasonic heat treatment. Alternatively, the liquid transfer arrangement 96 can be releasably connected to the liquid reservoir 92 through a threaded connection 160 (as seen in the figures).

The plunger 106 has a first end configured as a liquid delivery portion 108 and a second end configured as a liquid intake portion 112. The liquid delivery portion 108 is located outside housing and is configured to be insertable into the mouthpiece portion (the refill side) 4 of the electronic cigarette 2. The liquid intake portion 112 is located inside the housing on the opposite end of the plunger 106.

The liquid intake portion 112 comprises at least one liquid inlet 114. The liquid inlet in the liquid intake portion is in fluidic communication with the liquid reservoir 92. The liquid delivery portion 108 comprises at least one liquid outlet 110. The liquid outlet 110 is configured to deliver liquid into the liquid store 10 of the mouthpiece portion 4 in the electronic cigarette 2. The liquid inlet 114 and the liquid outlet 110 are in fluid communication by a channel 107 connecting them within the plunger 106. The liquid can advantageously be expelled by squeezing the refill bottle 90 and holding it upside down.

The plunger 106 is configured to move in the axial direction of the bottle 90 between and extended position and a depressed position. In the extended position the plunger 106 is extending out from the housing 98 at its maximum such that the liquid inlets 112, 114 are closed and in the retracted position, the plunger 106 is retracted against a biasing member 104 into the housing 98 such that the liquid inlets 114 are in fluid communication with the liquid in the reservoir 92. The plunger 106 is connected to the biasing member 104 which is configured to bias the plunger 106 into the extended position. The extended position is thus a rest position of the plunger 106. The biasing member 104 can be a compression spring or any elastic resilient material. The plunger 106 can be depressed by applying an axial force exceeding the biasing force, whereby the refill bottle 90 is open.

It is desirable to fixedly connect the refill bottle 90 to the mouthpiece portion 4 during refilling to ensure that the valves of the refill bottle and the mouthpiece portion are in a correct axial position. The housing 98 of the refill bottle 90 and the mouthpiece portion 4 may therefore further comprise an inter-engaging locking mechanism. The locking mechanism is configured to releasably connect the mouthpiece portion and the refill bottle during refilling. The inter-engaging locking arrangement may be configured as a bayonet coupling. The housing of the fluid transfer arrangement may therefore be provided with a locking element 115, such as a locking pin. In the illustrated embodiment, the locking pin 115 may extend in the transverse direction (in relation to the axial direction of the bottle). The mouthpiece portion of the electronic cigarette will therefore be provided with marching cut-out and groove. Alternatively, in a non-illustrated embodiment, the inter-engaging locking arrangement may be provided as a screw connection.

As best seen in FIGS. 11*a* to 11*d*, a fluidic connection between the mouthpiece portion 4 and the refill bottle 90 is established when the mouthpiece portion 4 and the liquid transfer arrangement 96 are connected.

In their rest position (when they are not connected), the liquid store 10 and the refilling valve 100 are both biased into a closed position. However, the valve 40 of the liquid store and the valve 100 of the refill bottle are opened when the refill bottle 90 and the mouthpiece portion 4 are engaged with each other. The plunger 106 of the refill bottle 90 can be depressed by engagement with the closing member 44 of the valve 40 in the mouthpiece portion 4. In the same way, the closing member 44 in the mouthpiece portion 4 is moved upwards away from the sealing surface such that the liquid opening 7 in the bottom surface S2 of the liquid store 10.

In order to avoid leakage and expulsion of excess liquid that does not enter the liquid store in the mouthpiece portion, it is desirable that the liquid store 10 of the mouthpiece portion 4 remains open longer than the refill bottle 90 in order to receive liquid whenever the valve in the refill bottle 90 is opened.

To this effect, the spring coefficient of the liquid store 10 in the mouthpiece portion 4 can be smaller than the spring coefficient of the refill recipient 90 such that the liquid store 10 opens before the refill bottle 90 and closes after the refill bottle 90. In an exemplary embodiment, the spring coefficient of the liquid refill bottle is 3 N/mm and the spring coefficient of the mouthpiece liquid store is 1.145 N/mm.

The liquid inlets 114 are preferably in a transverse direction in relation to the axial direction of the plunger 106. The housing 98 further comprises an annular seal arranged around the inner circumference of the housing. The seal is provided in an axial position which coincides with the position of the liquid inlets when the plunger 106 is in a rest position. Hence, the liquid inlets are closed off by the seal when the plunger is in an extended position.

The liquid outlets 110 in the plunger 106 can also be in the transverse direction in relation to the axial direction of the plunger 106. The top portion is thus configured to abut against the bottom flange of the closing member 44. A liquid passage is formed in the horizontal direction of the liquid store 10 as the sleeve is moved up. By having the liquid outlets arranged in the transverse direction, liquid can freely flow into the liquid store.

The liquid delivery portion of the plunger 106 further comprises an annular seal 113 which is located axially between the liquid outlets 110 and the liquid inlets 114, wherein the seal 113 is configured to seal against an internal housing of the mouthpiece portion.

It will be understood that well known processes and elements have not been described in detail and may have been omitted for brevity. Specific steps, structures and materials have been described, by way of example. However, the present disclosure is not limited to those specific examples. It will be appreciated that some of the specific features described may be substituted for well-known alternatives, and that the method steps described may not necessarily be performed in the sequences given by way of example.

This disclosure has described a number of separate embodiments. However, it will be understood that features of different embodiments may be combined in any conceivable permutation. Other changes, substitutions, and alterations are also possible without departing from the scope of the claims.

The invention claimed is:

1. An electronic cigarette comprising a mouthpiece portion and a power supply portion, wherein the power supply portion comprises:

an atomizer seating configured to receive an atomizer, an atomizer lock located in the atomizer seating and movable between an open position and a locked position, wherein the atomizer lock is configured to selectively grip the atomizer when the atomizer is received in the atomizer seating and release the atomizer from the atomizer seating, the atomizer lock including an outer sleeve and an inner sleeve, which is rotatable in relation to the outer sleeve, and an actuator configured to selectively rotate the inner sleeve relative to the outer sleeve in order to grip or release the atomizer wherein the atomizer is configured to rotate in unison with the inner sleeve, and an ejection mechanism comprising a biased ejection surface movable within the atomizer seating between a retracted position and an extended position, wherein the ejection surface is biased towards the extended position, wherein the ejection mechanism is movable into the retracted position when an atomizer is introduced into the atomizer seating, and the atomizer lock is configured to grip the atomizer and hold the atomizer in a fixed position, and wherein the atomizer is ejected from the atomizer seating when the atomizer lock is opened.

2. The electronic cigarette of claim 1, wherein the atomizer is gripped or released depending on a rotational position of the inner sleeve in relation to the outer sleeve.

3. The electronic cigarette of claim 1, further comprising an atomizer which comprises a first engagement element configured to engage with the inner sleeve and a second engagement element configured to engage with the outer sleeve.

4. The electronic cigarette of claim 3, wherein the second engagement element is an annular flange and the first engagement element is a slot or cut-out in the annular flange that defines an axial keyway through the flange.

5. The electronic cigarette of claim 4, wherein the inner sleeve comprises a second protrusion and the outer sleeve comprises a first protrusion, wherein the first and second protrusions extend radially inwards into the atomizer seating, and wherein the first protrusion on the outer sleeve can be aligned with the second protrusion upon rotation of the actuator such that the keyway of the atomizer can pass in an axial direction over the first protrusion and the second protrusion and be accommodated in the atomizer seating.

6. The electronic cigarette of claim 5, wherein the first protrusion is axially positioned to be aligned with the annular flange and the second protrusion is axially positioned to be above the first protrusion such that the annular flange can pass below the second protrusion;

wherein the annular flange of the atomizer is unlocked from the atomizer seating when the first and second protrusions are aligned with each other such that the atomizer is released from the atomizer seating; and wherein the annular flange of the atomizer is locked in the atomizer seating when the first and second protrusions are misaligned from each other such that the second protrusion is positioned above and abutting the annular flange.

7. The electronic cigarette of claim 1, wherein the inner sleeve comprises one or more resilient tongues and the outer sleeve comprises slots configured to accommodate the one or more resilient tongues.

8. The electronic cigarette of claim 7, wherein the one or more resilient tongues comprise free guiding ends to enable the one or more resilient tongues to move in and out of the slots when a torque above a threshold level is applied to the inner sleeve.

9. The electronic cigarette of claim 1, wherein the atomizer is biased in a direction out of the atomizer seating, such that when the atomizer is released from the atomizer lock, the atomizer is ejected.

10. The electronic cigarette of claim 1, wherein the power supply portion further comprises a biasing member biased against a stationary surface in the power supply portion and provides biasing for the ejection mechanism.

* * * * *